US011473028B2

(12) United States Patent
Baralt et al.

(10) Patent No.: US 11,473,028 B2
(45) Date of Patent: Oct. 18, 2022

(54) BASE OILS AND METHODS OF MAKING THE SAME

(71) Applicant: Novvi LLC, Emeryville, CA (US)

(72) Inventors: Eduardo Baralt, Houston, TX (US); Jason Wells, Fremont, CA (US); Jason Charles Rosalli, Oakland, CA (US); Wui Sum Willbe Ho, Oakland, CA (US); Liwenny Ho, Oakland, CA (US); Benton Thomas, Elizabethtown, NC (US)

(73) Assignee: Novvi LLC, Emeryville, CA (US)

( * ) Notice: Subject to any disclaimer, the term of this patent is extended or adjusted under 35 U.S.C. 154(b) by 0 days.

(21) Appl. No.: 16/630,315

(22) PCT Filed: Jul. 13, 2018

(86) PCT No.: PCT/US2018/041981
§ 371 (c)(1),
(2) Date: Jan. 10, 2020

(87) PCT Pub. No.: WO2019/014533
PCT Pub. Date: Jan. 17, 2019

(65) Prior Publication Data

US 2020/0216772 A1 Jul. 9, 2020

Related U.S. Application Data

(60) Provisional application No. 62/532,719, filed on Jul. 14, 2017.

(51) Int. Cl.
*C10M 105/04* (2006.01)
*C10G 50/02* (2006.01)
(Continued)

(52) U.S. Cl.
CPC ..... *C10M 105/04* (2013.01); *C10G 50/02* (2013.01); *C10M 177/00* (2013.01);
(Continued)

(58) Field of Classification Search
None
See application file for complete search history.

(56) References Cited

U.S. PATENT DOCUMENTS 4,284,522 A 8/1981 Olmsted
4,910,355 A 3/1990 Shubkin et al.
(Continued)

FOREIGN PATENT DOCUMENTS

EP 1969607 B1 3/2010
EP 2222823 9/2010
(Continued)

OTHER PUBLICATIONS

Patent Cooperation Treaty, International Search Report for PCT/US2018/041981, 6pgs. dated Nov. 26, 2018.
(Continued)

*Primary Examiner* — Philip Y Louie
(74) *Attorney, Agent, or Firm* — Bryan Cave Leighton Paisner LLP

(57) ABSTRACT

Aspects of the present disclosure relate to a process for producing synthetic hydrocarbon base oils having advantageous properties for formulation of engine oils, and the base oils obtained by such processes, involving the production of branched alkenes from the oligomerization of C14-C18 olefins. According to one embodiment, the base oils are obtained by first forming a mixture of two or more olefins ranging from C14-C18, where one of the olefins is an alpha olefin and the other has an average double bond position between 1.5-5.0, and oligomerizing this mixture in the presence of a catalyst to form one or more branched alkenes,
(Continued)

hydrogenating the branched alkenes, and fractionating to form base oils. According to one aspect, advantageous properties can be obtained by controlling one or more of the degree of branching, branch length, branching positions, selection of the C14-C18 olefins, and catalytic isomerization, during or after the oligomerization process.

24 Claims, 11 Drawing Sheets

(51) Int. Cl.

| | |
|---|---|
| ***C10M 177/00*** | (2006.01) |
| *C10N 20/00* | (2006.01) |
| *C10N 30/00* | (2006.01) |
| *C10N 30/02* | (2006.01) |

(52) U.S. Cl.
CPC . *C10M 2203/022* (2013.01); *C10M 2203/024* (2013.01); *C10N 2020/069* (2020.05); *C10N 2020/071* (2020.05); *C10N 2030/02* (2013.01); *C10N 2030/74* (2020.05)

(56) References Cited

U.S. PATENT DOCUMENTS

| | | | |
|---|---|---|---|
| 5,105,039 | A | 4/1992 | Pelrine |
| 5,132,477 | A | 7/1992 | Ho et al. |
| 5,264,642 | A | 11/1993 | Wu |
| 5,767,047 | A | 6/1998 | Duncan et al. |
| 5,817,899 | A | 10/1998 | Hope et al. |
| 5,922,658 | A | 7/1999 | Duncan et al. |
| 6,313,077 | B1 | 11/2001 | Stunnenberg et al. |
| 6,398,986 | B1 | 6/2002 | McShane |
| 7,456,329 | B2 | 11/2008 | Wu et al. |
| 7,544,850 | B2 | 6/2009 | Goze et al. |
| 7,691,792 | B1 | 4/2010 | Fisher et al. |
| 7,795,484 | B2 | 9/2010 | Koivusalmi |
| 8,124,820 | B2 | 2/2012 | Tiitta et al. |
| 8,268,199 | B1 | 9/2012 | Forest |
| 9,206,095 | B2 | 12/2015 | Bagher et al. |
| 9,266,793 | B2 | 2/2016 | Gee |
| 10,501,670 | B2 | 12/2019 | Hahn et al. |
| 2001/0001804 | A1 | 5/2001 | Skledar et al. |
| 2002/0139962 | A1 | 10/2002 | Fefer et al. |
| 2006/0027361 | A1 | 2/2006 | Hanson et al. |
| 2007/0225534 | A1 | 9/2007 | Goze et al. |
| 2007/0259792 | A1 | 11/2007 | Null |
| 2007/0299291 | A1 | 12/2007 | Koivusalmi |
| 2008/0146469 | A1 | 6/2008 | Sato et al. |
| 2008/0283803 | A1 | 11/2008 | Rapp |
| 2009/0036337 | A1 | 2/2009 | Deskin et al. |
| 2009/0137435 | A1 | 5/2009 | Hilker |
| 2009/0181871 | A1 | 7/2009 | Shah et al. |
| 2009/0326296 | A1 | 12/2009 | Brillantes et al. |
| 2010/0048438 | A1 | 2/2010 | Carey et al. |
| 2010/0059725 | A1 | 3/2010 | Sinclair et al. |
| 2010/0152072 | A1 | 6/2010 | Nelson et al. |
| 2011/0195884 | A1 | 8/2011 | Crouthamel et al. |
| 2011/0287988 | A1 | 11/2011 | Fisher et al. |
| 2011/0288256 | A1 | 11/2011 | Vermeiren |
| 2011/0306529 | A1 | 12/2011 | Schober et al. |
| 2012/0071367 | A1 | 3/2012 | Falana et al. |
| 2012/0119862 | A1 | 5/2012 | Franklin et al. |
| 2012/0209039 | A1 | 8/2012 | Wright |
| 2012/0323055 | A1 | 12/2012 | Gruber et al. |
| 2013/0090273 | A1 | 4/2013 | Martin et al. |
| 2013/0217606 | A1 | 8/2013 | Wang et al. |
| 2013/0253244 | A1 | 9/2013 | Emett et al. |
| 2013/0267450 | A1 | 10/2013 | Patil et al. |
| 2014/0194333 | A1 | 7/2014 | Dance et al. |
| 2014/0323665 | A1 | 10/2014 | Wu et al. |
| 2015/0322365 | A1 | 11/2015 | Jeon et al. |
| 2016/0264493 | A1 | 9/2016 | Small et al. |
| 2017/0121630 | A1 | 5/2017 | Vettel et al. |
| 2017/0130161 | A1 | 5/2017 | Vettel et al. |
| 2017/0240832 | A1 | 8/2017 | Hahn et al. |
| 2017/0305819 | A1 | 10/2017 | Wells et al. |
| 2018/0119033 | A1 | 5/2018 | Tirmizi et al. |
| 2019/0264112 | A1 | 8/2019 | Tirmizi et al. |
| 2019/0264122 | A1 | 8/2019 | Rosalli et al. |
| 2019/0338211 | A1 | 11/2019 | Baralt et al. |
| 2020/0095177 | A1 | 3/2020 | Baralt et al. |
| 2020/0165538 | A1 | 5/2020 | Baralt et al. |
| 2020/0216772 | A1 | 7/2020 | Baralt et al. |

FOREIGN PATENT DOCUMENTS

| | | |
|---|---|---|
| EP | 2236590 | 10/2010 |
| EP | 3052600 | 8/2016 |
| JP | 2008115301 | 5/2008 |
| WO | 9810042 | 3/1998 |
| WO | 0026925 | 5/2000 |
| WO | 03020856 | 3/2003 |
| WO | 2007140339 | 12/2007 |
| WO | 2010115097 | 10/2010 |
| WO | 2012141783 | 10/2012 |
| WO | 2012141784 | 10/2012 |
| WO | 2013101414 | 7/2013 |
| WO | 2013130372 | 9/2013 |
| WO | 2014128227 A1 | 8/2014 |
| WO | 2014154802 A1 | 10/2014 |
| WO | 2016182930 | 11/2016 |
| WO | 2019212674 | 11/2019 |

OTHER PUBLICATIONS

Patent Cooperation Treaty, International Search Report for PCT/US2018/041993, 6pgs. dated Nov. 29, 2018.

Patent Cooperation Treaty, International Search Report for PCT/US15/21018, dated Jul. 3, 2015, 4 pages.

Patent Cooperation Treaty, International Search Report dated Aug. 31, 2015 for PCT/US2015/035651, 5 pages.

Patent Cooperation Treaty, International Search Report for PCT/US15/35656, dated Aug. 31, 2015, 5 pages.

Patent Cooperation Treaty, International Search Report for PCT/US2015/056430, dated Feb. 4, 2016, 5 pages.

Patent Cooperation Treaty, International Search Report for PCT/US2015/055249, dated Feb. 29, 2016, 5 pgs.

Patent Cooperation Treaty, International Search Report for PCT/US2016/031274, dated Aug. 8, 2016, 4 pages Aug. 8, 2016.

Smith et al., Vitamin E. XLII. Long Chain Aliphatic Compounds with Recurring "Isoprene" Units, J. Am. Chem. Soc., 1943, 65 (5), pp. 745-750 May 12, 1943.

European Patent Office, Extended European Search Report dated Oct. 20, 2017, 9 pages Oct. 20, 2017.

Challener, C., Base oils 2014: Green lubricants continue progress, ICIS Chemical Business, retrieved from www.icis.com/resources/news/2014/02/11/9752026/base-oils-2014-green-lubricants-continue-progress/, 8 pages Feb. 11, 2014.

European Patent Office, Extended European Search Report issued for App. No. 15764090.5; Pub. No. 3120368, 6 pages dated Oct. 19, 2017.

Cooper, Tim, Industrial Lubricants 2008, retrieved from energy.org.il/wp-content/uploads/2017/01/nrg510.pdf 2006.

European Patent Office, Extended European Search Report for 15806655.5, 8 pages dated Dec. 19, 2017.

Patent Cooperation Treaty, International Search Report for PCT/US2017/060585, 4 pages dated Feb. 19, 2018.

European Patent Office, Extended European Search Report for Application No. 15851673.2, publication EP 3209630, 11 pages dated Apr. 26, 2018.

Hernaindez-Torres et al., Stereocontrolled generation of the (2R) chroman core of vitamin E: total synthesis of (2R,4'RS,8'RS)-alpha-tocopherol, Organic Letters, 2009, 11(21): 4930-4933 2009.

Sinnenghe Damste et al., The identification of 2,3-dimethyl-5-(2,6,10-trimethylundecyl)thiophene, a novel sulphur containing biological marker, Tetrahedron Letters, 1987, 28(9): 957-960 1987.

(56) References Cited

OTHER PUBLICATIONS

Odinokov et al., New Enantiospecific synthesis of (+)-2R,6R)-(+)-2,6,10-Trimethylundecan-1-ol for constructing the side chain of natural (2R,4'5,8'R)-(+)-[alpha]-Tocopherol (Vitamin E), Doklady Chemistry, Kluwer Academic Publishers—Plenum Publishers, NE, 2005, 403(4-6): 144-147 2005.

European Patent Office, Extended European Search Report for Application No. 15850492.8, publication EP 3207110, 10 pages dated Apr. 20, 2018.

European Patent Office, European Supplemental Search Report for Application No. 16793265.6, publication EP 3294840, 13 pages dated Oct. 30, 2018.

Mattei, G., et al.,Synthetic Lubricants And High-Performance Functional Fluids, Revised And Expanded, edited by L. R. Rudnick and R. L. Shubkin, CRC Press, Chapter 2: 53-62 Mar. 10, 1999.

Ineos, Safety Data Sheet Durasyn 125 Polyalphaolefin, 11 pages, retrieved from www.ineos.com/products/?fs=Polyalphaolefin%2b(PAO)%2b-%2bLow%2bViscosity Mar. 5, 2021.

Dong et al., Preparation and Characterization of Single-Component Poly-α-olefin Oil Base Stocks, Energy & Fuels, 33: 9796-9804 2019.

Kapur et al., Detailed characterisation of polyalphaolefins and their branched structures using multi-pulse NMR techniques, Journal of Synthetic Lubrication, 15(3): 177-191 1998.

Figure 9 Isomerization and hydrogenation of C14 and C16 olefin dimers.
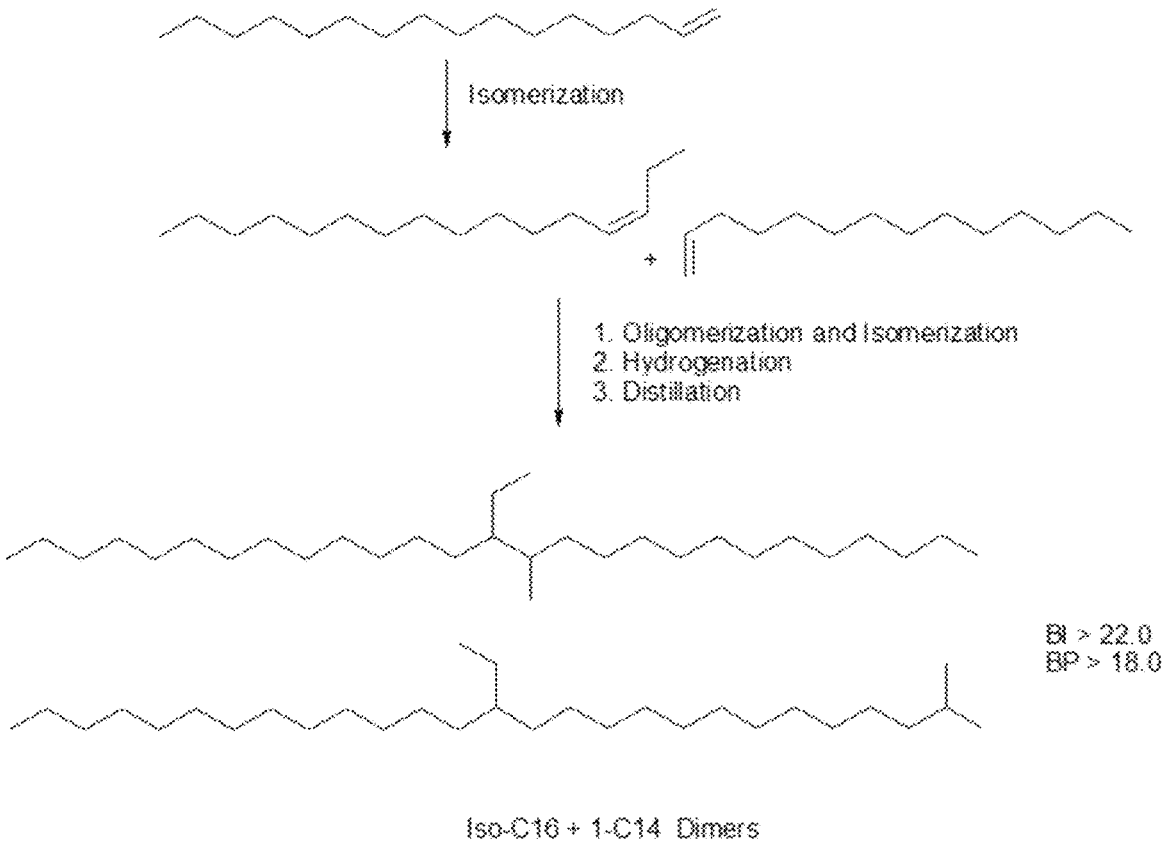

Figure 10. A representative example of a 1-tetradecene and 1-hexadecene 4 cSt Dimer.
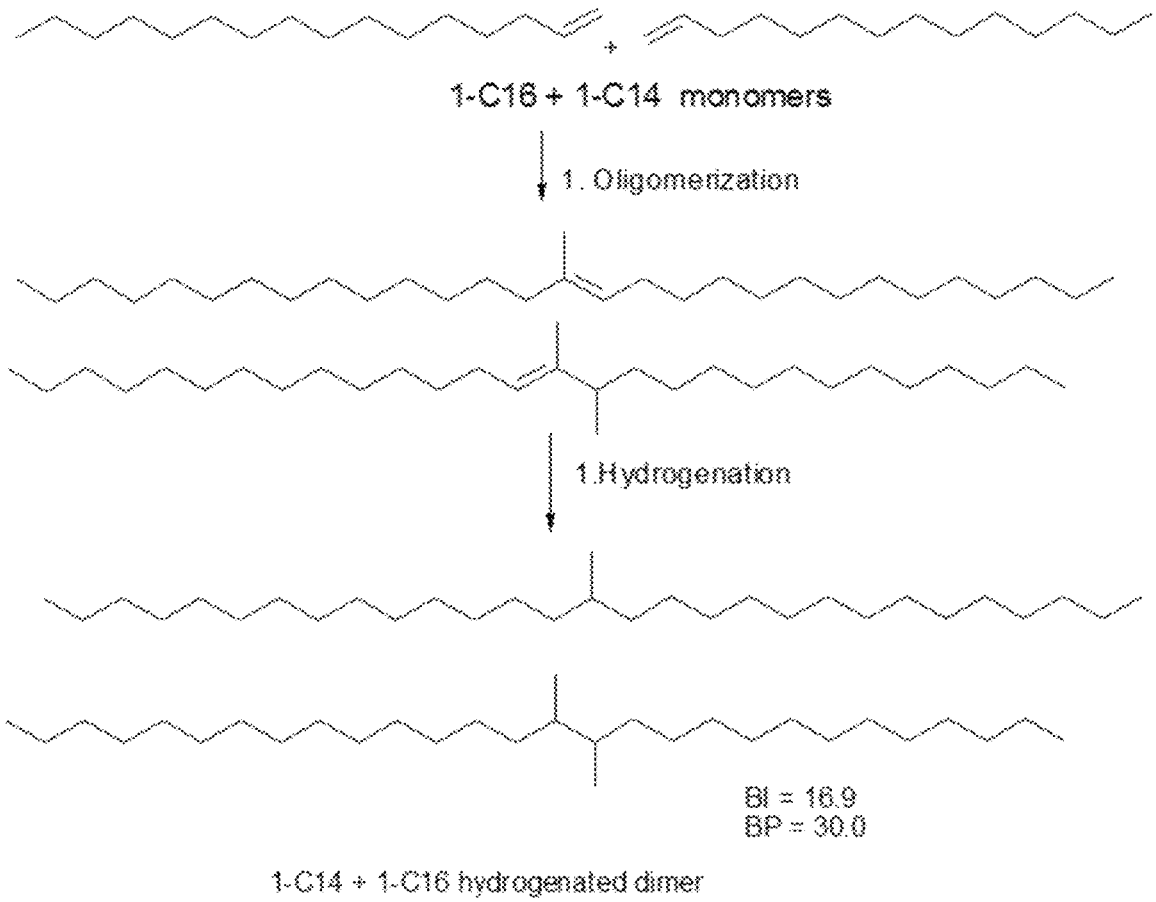

Figure 11. Representative example of 1-Decene trimer 4 cSt PAO.
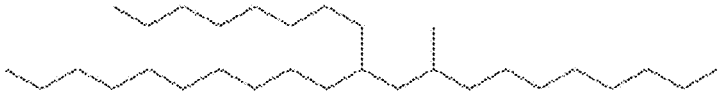
1-C10 Trimer PAO Hydrocarbon Chain
BI = 19.4
BP = 3
Figure 12. Representative example of a 4 cSt base oil typical of a Fischer-Tropsch synthesis or Gas to liquids (GTL).
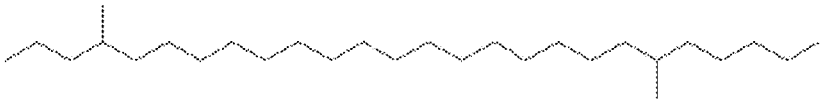
GTL Hydrocarbon Chain
BI = 19.4
BP = 26.7

Figure 13. Carbon labeling representation for a representative example of isomers of a GTL C30H62 paraffin used for lubricant applications.
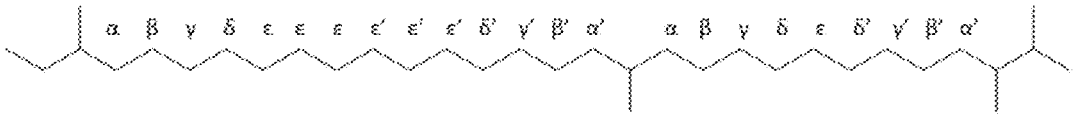

BASE OILS AND METHODS OF MAKING THE SAME

FIELD

Aspects of the present disclosure generally relate to isoparaffin oligomers derived from C14 through C18 olefins, such as one or more of linear internal, branched internal and alpha-olefins. According to certain aspects, the isoparaffinic oligomers may be used as lubricant base oils.

BACKGROUND OF THE INVENTION

Poly alpha-olefins (PAOs) and Poly internal-olefins (PIOs) make up an important class of hydrocarbon lubricating oils. They are typically produced by the polymerization of alpha-olefins or internal-olefins in the presence of a Friedel Craft catalyst such as $AlCl_3$, $BF_3$, or $BF_3$ complexes. For example, 1-octene, 1-decene, 1-dodecene, and 1-tetradecene have been used to manufacture PAOs. Similarly, C8-18 internal olefins have been used to manufacture PIOs. Oligomerization of these olefins is typically followed by fractionation and hydrogenation to remove any remaining unreacted hydrocarbons and unsaturated moieties. Disclosures of processes for making PIOs can be found, for example, in EP 1,104,747, EP 0,776,960, and U.S. Pat. No. 4,910,355.

Hydrocarbon lubricating oils are commonly categorized by kinematic viscosity (KV) in centistokes (cSt), measured at 100° C. according to ASTM D445. For example, 2 cSt, 2.5 cSt, 4 cSt, 5 cSt, 6 cSt, 7 cSt, 8 cSt, and 9 cSt PAOs and PIOs have been prepared comprising various combinations of oligomers and homopolymers of C8-C18 linear mono-olefins. PAOs and PIOs were developed as high-performance functional lubricating oils that have improved performance, e.g., over a wide operational temperature range.

The automotive industry is placing greater demands on engine oils, operating at higher temperatures for longer times and requiring lower viscosity engine oil formulations such as 0W-30 and 0W-20 engine oils which improve vehicle fuel economy by lowering friction losses. This is driving a demand for low viscosity PAOs and PIOs, such as around 4 cSt kinematic viscosity, while maintaining low Noack volatility and good low-temperature performance properties. Thus, a need exists for low viscosity base oils which exhibit advantageous properties which may include a low Noack volatility, calculated according to ASTM D 5800 Standard Test Method for Evaporation Loss of Lubricating Oils by the Noack Method, and that may also include a low cold-crank viscosity (i.e. dynamic viscosity according to ASTM D 5293), and can include the ability to pass a stricter 0W engine oils viscometric requirement.

Prior efforts to prepare various PAOs that can meet the increasingly stringent performance requirements of modern lubricants and automotive engine oil particularly have favored low viscosity polyalphaolefin base oils derived from 1-decene alpha-olefins, alone or in some blend with other mineral or Fischer-Tropsch derived base oils. However, the polyalphaolefin derived from 1-decene can be prohibitively expensive, due the high cost of 1-decene as a result of its significantly limited availability. Furthermore, there is generally a need for new base oils with improved properties, and methods of manufacture thereof, including base oils comprising PAOs and/or PIOs derived from materials other than 1-decene.

Commercially, some C28 to C36 oligomers of alpha olefins are made from a mixed feed of C8, C10 and C12 alpha olefins, with 1-decene being incorporated for the purpose of imparting the most desirable properties. In contrast, 4 cSt PAOs and PIOs made without decene have yielded base oils lacking in one or more important physical properties. Thus, PAOs made from mixed alpha-olefin feeds such as the C28 to C36 oligomers described above may have the advantage that they lower the amount of decene that is needed to impart predetermined properties. However, they still do not completely remove the requirement for providing decene as a significant proportion of the oligomer. Furthermore, the process to make these PAOs may also result in the production of significant quantities of cross-oligomers that do not have the desired properties for a 4 cSt base oil. Accordingly, narrow distillation cuts must typically be taken to select only the oligomers having the desired properties, resulting in undesirably low yields of functional product.

Accordingly, there remains a need for a base oil composition having properties within commercially acceptable ranges, such as properties including the viscosity, Noack volatility, and low temperature cold-cranking viscosity, for use in automotive and other applications, as well as a method of manufacturing such base oil compositions. Furthermore, there remains a need for base oil compositions having improved properties and methods of manufacture thereof, where the base oil compositions have reduced amounts of 1-decene incorporated therein, and may even eliminate the use of 1-decene in the manufacture thereof.

Also, the demand for low viscosity (e.g., 4 to 10 cSt at 100° C.) PAOs outpace the supply. Specifically, it is highly desirable to produce a lubricant base oil that has similar or equivalent properties to the C10 trimer based PAO (often referred to as 4 cSt PAO). There is also a continuing need for improved base oils, e.g. base oils that have a wide operational temperature range, and a continuing need for base oils derived from renewable feedstock.

PIOs are not used commercially today, although they have been sold in the market historically. Their properties are inferior to PAOs, and not useful for lower viscosity engine oil formulations such as 0W-30 and 0W-20 engine oils. For example, a 4 cSt PIO made from internal olefins having a branching ratio of CH3/CH2 (as determined by 1H NMR) of 0.2083, a viscosity of 4.33 cSt at 100° C., a VI of 122 and a pour point of −54 C has the flaw that its Noack volatility is too high, at 15.3 (Reference: Synthetic Lubricants And High-Performance Functional Fluids, Revised And Expanded. Edited by Leslie R. Rudnick and Ronald L. Shubkin; CRC Press 1999, Table 1, page 55).

Oligomerization catalysts and processes for making base oils materials from alpha olefins and internal olefins are described, for example, in U.S. Pat. No. 4,910,355. According to this disclosure, and olefin oligomer functional fluid is prepared using internal olefins. Specifically, olefin oligomers are obtained by a mixture of C8-18 olefins containing 50-90 weight percent α-olefins and 10-50 weight percent internal olefins and oligomerizing this mixture using a Friedel Crafts catalyst (e.g. BF3) and a promoter (e.g. n-butanol), to form trimers. The mixture of olefins can be formed from α-olefins (e.g. 1-decene) by subjecting the α-olefins to isomerization until 10-50 weight percent of the olefins are internal olefins. In this disclosure, the pour points of the exemplified C10 trimer are very good, but the Viscosity Index (VI) is less than 110 for a mixture of 50:50 1-decene: internal decenes; which is below the acceptable VI for 0W-20 motor oils.

EP 0,136,377 discloses the oligomerization of at least 99 wt. % of internal mono olefins to make PIOs having 9 to 24 carbon atoms, with a catalyst comprising boron trifluoride;

the product made here have either too high viscosity, >4.3 cSt at 100° C. or the VI is 124 or less. The Noack volatility is also >16%. Conversion to the 4 cSt fraction are not disclosed. U.S. Pat. No. 5,453,556 discloses the oligomerization of alpha and internal olefins using a tungstate modified zirconia; in one example, the reaction of an aloha and internal C14 olefin produce products with higher viscosities (>4.72 cSt at 100° C.) than what is desired; the pour points are relatively high (−25 and −28° C.). In U.S. Pat. No. 7,456,329 a feedstock of unsaturated olefins is oligomerized to form an unsaturated polyolefin; the saturated dimer requires isomerization over a zeolite catalyst to lower the pour point from −17° C. (which remains excessively high). The other deficiency of this patent is the viscosities at 100° C. are greater than 4.5 cSt. U.S. Pat. No. 8,124,820 discloses oligomerizing alpha olefins to produce dimers and oligomers over a solid catalyst in a continuous flow reactor. In one example, dimers of 1-hexadecene were made with pour points that are excessively high, at higher than −25° C., VI >140 and vis >4.2 cSt at 100° C.; however, the conversion to products is less than 60% and the selectivity to dimer is about 90%. U.S. Pat. No. 8,501,675 High viscosity novel base oil lubricant viscosity blends; —viscosity of at least 135 cSt, KV 100° C. and a CH3/CH2 branch ratio less than 0.19 (or 19%). In US 20100298616 a feed comprising olefins having at least 10 carbons are simultaneously hydrogenated and isomerized in the presence of hydrogen at a temperature and a hydrogenation/isomerization catalyst.

U.S. Pat. No. 5,264,642 discloses that the molecular structure of alpha olefins oligomers correlates very well with improved lubricant properties in commercial synthetic lubricants. Specifically, the reference discloses that one characteristic of the molecular structure of saturated olefin oligomers that has been found to correlate very well with improved lubricant properties in commercial synthetic lubricants is the ratio of methyl to methylene groups in the oligomer (e.g., as measured by 1H NMR, also referred to as the branch ratio). U.S. Pat. No. 5,264,642 discloses that the Viscosity Index for the PAOs disclosed therein increases with lower branch ratios. According to this reference, PAOs prepared from 1-decene by cationic polymerization, and having branch ratios of greater than 0.20 (with branching occurring by rearrangement, isomerization, or other mechanism), yield synthetic lubricants with excessive branching, which constrains the lubricant properties, particularly with respect to viscosity index. That is, U.S. Pat. No. 5,264,642 discloses that a branching ratio greater than 0.20 results in a base oil with poor lubricant properties, and especially a poor viscosity index.

Furthermore, PAOs existing in the market today are derived from fossil fuels, and hence are not renewable. Therefore, it is also desirable to produce base oils and PAOs from renewable sources.

In U.S. Pat. No. 8,449,760 a Fischer-Tropsch derived base oil lubricant is described with properties including −19° C. Pour Point, a viscosity at 40° C. of 17.55 cSt, and a viscosity at 100° C. of 4.303 cSt, with a VI of 161. Accordingly, while the viscosity properties are excellent, this lubricant is deficient as the pour point is only −19° C. (i.e., too high). Other low temperature properties such as CCS are not disclosed but it can be surmised by the pour point that they have a −35° C. CCS of the disclosed lubricant is not optimum for 0W engine applications (i.e., too high). A low CCS at −35° C. is required for 0W engine oil applications.

Other processes using F-T wax feeds for making base oils are described in U.S. Pat. No. 7,795,484, US 20130317263, U.S. Pat. No. 9,464,238, US 20110054230, US 20110132803, U.S. Pat. Nos. 5,608,122, 7,795,484, US 20090014354, and US 20120238788.

SUMMARY

Provided herein are novel compositions and methods for preparation of a novel base oil having improved properties, such as including at least one of an excellent Viscosity index (VI), Cold Crank Simulation viscosity (ASTM D 5293), and Noack Volatility. According to one aspect, the composition includes a mixture of olefin feedstocks having a carbon chain length in a range of from C14 to C18, where at least one of the olefin feeds has an average double bond position between 1.5 and 5.0 (e.g., as measured by gas chromatography). Additional olefin feedstocks, may optionally be provided, such as with greater than 90% alpha olefin.

In certain advantageous embodiments, the base oils are derived from one or more alpha-olefin feedstocks where a portion of at least one alpha-olefin feedstock has been isomerized to yield an internal olefin having a defined average double-bond position. According to this embodiment, the isomerized alpha olefin portion of the feedstock and the un-isomerized alpha-olefin form an olefin feed mixture. The olefin feed mixture may comprise by wt % at least about 30%, at least about 40%, at least about 50%, at least about 60%, at least about 70%, at least about 80%, at least about 90%, or even at least about 100% internal olefin, where the average double bond position of the internal olefin is controlled to be in a range between 1.5 and 5.0. According to one embodiment, the oligomer products have performance comparable to API Group III base oils or Group IV PAOs. Additionally, aspects of the present disclosure may provide, in certain embodiments, suitable sources of feedstocks for base oils and lubricant compositions that exhibit good properties over relatively wide temperature ranges, as described further herein.

In this embodiment, a low amount of isomerization takes place during oligomerization yielding a well-defined sharp singlet on the end of the initial peak grouping (trimer) which characterizes the singularly branched isomers.

Figure 5:
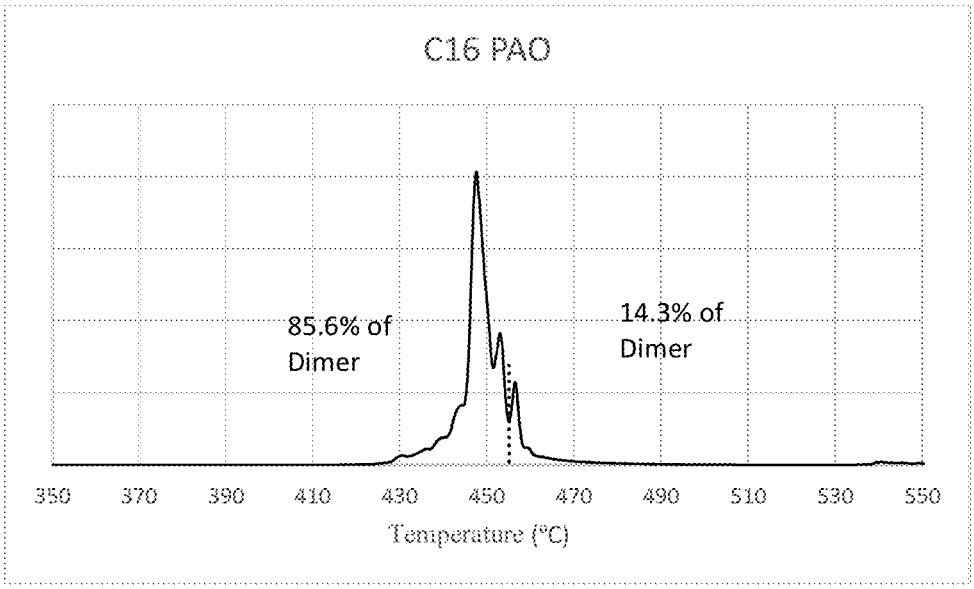

FIG. 5 shows an embodiment of a Simulated Distillation trace of a 1-Hexadecene PAO (Dimer) with low amounts of isomerization during oligomerization. Well-defined sharp peak on the end of the distribution represents the singularly branched dimers.

Figure 6:
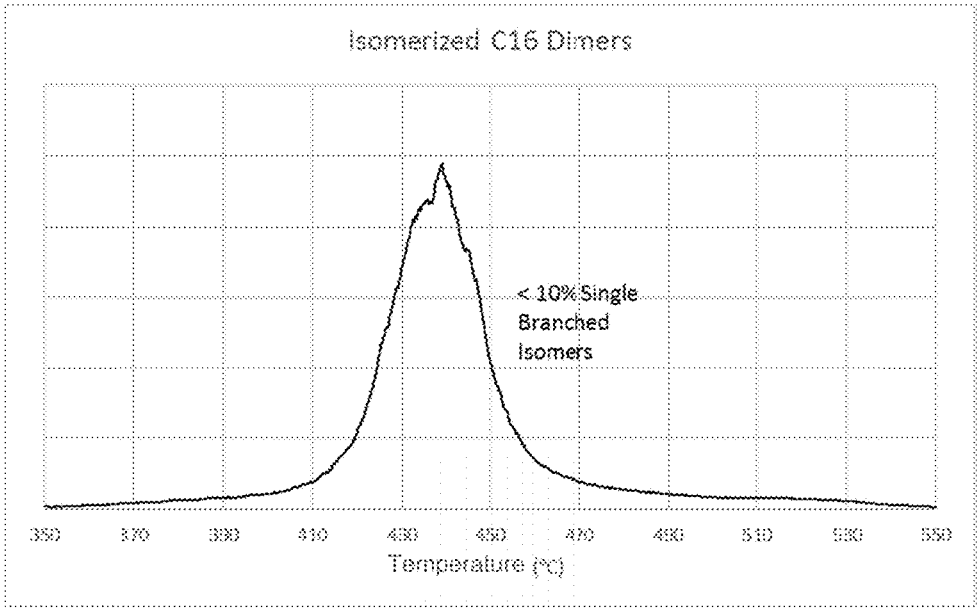

FIG. 6 shows an embodiment of a Simulated Distillation trace of Comparative Example E, Hexadecene Dimer with a high degree of isomerization from both feedstock isomerization and isomerization during oligomerization. In this embodiment, distinct linear dimer peaks have been isomerized to a degree in which they are inseparable by simulated distillation, method ASTM D 2887.

Figure 7:
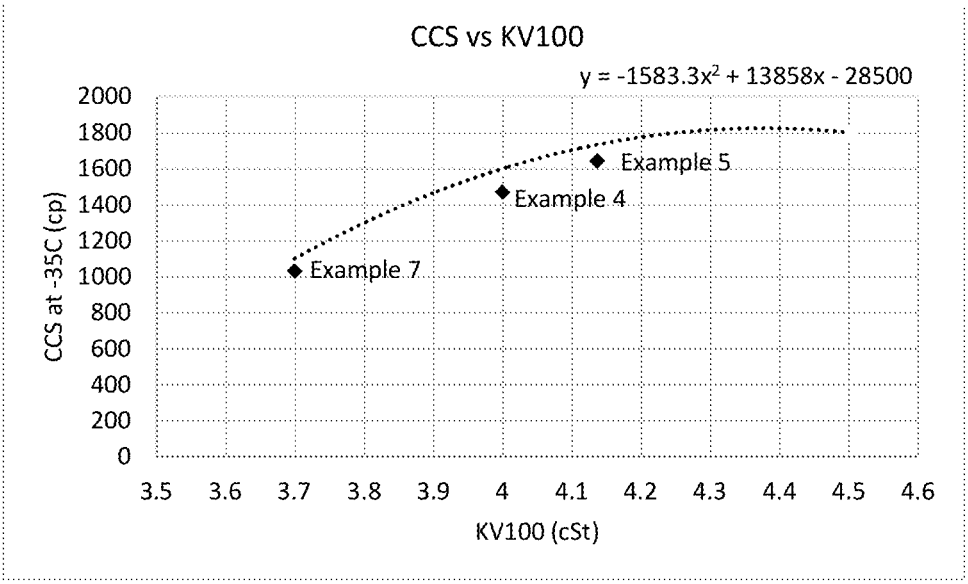

FIG. 7 is a graph showing an embodiment of a CCS and kinematic viscosity at 100° C. relationship, and which shows exemplary embodiments of the disclosure as those that fall below the curve drawn by the quadratic equation seen in FIG. 7.

Figure 8:
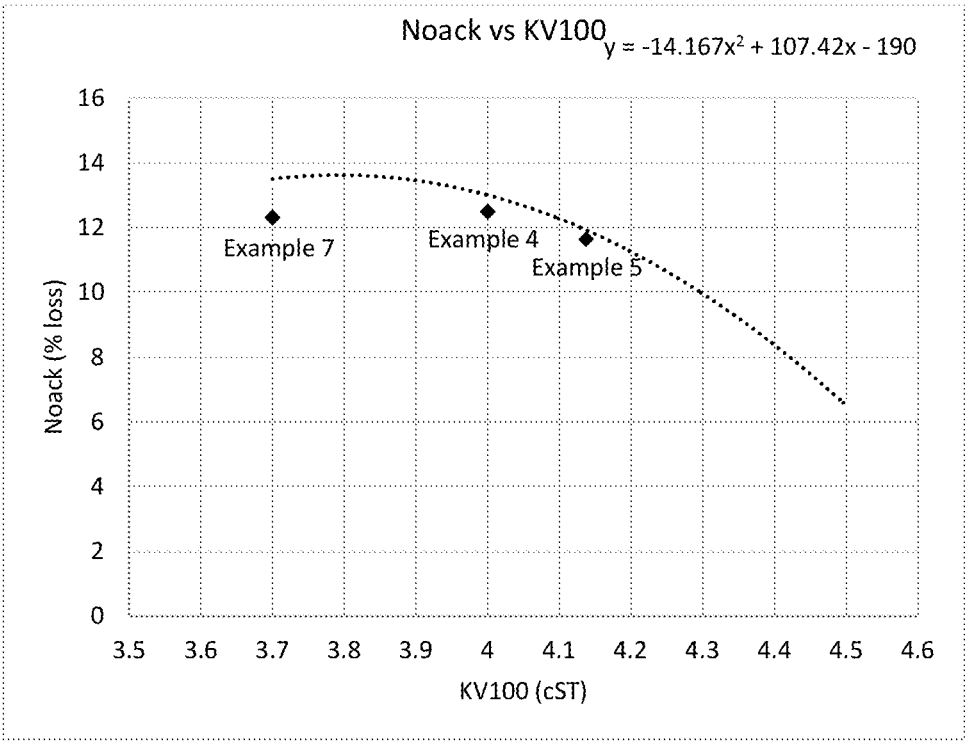

FIG. 8 is a graph showing an embodiment of a Noack Volatility and kinematic viscosity at 100° C. relationship, and which shows exemplary embodiments of the disclosure as those that fall below the curve drawn by the quadratic equation seen in FIG. 8.

FIG. 9 shows an embodiment of isomerization of the olefin monomer and hydrogenation of C14 and C16 olefin dimers.

FIG. 10 shows a representative example of a 1-tetradecene and 1-hexadecene 4 cSt Dimer.

FIG. 11 shows a representative example of 1-Decene trimer 4 cSt PAO.

FIG. 12 shows a representative example of a 4 cSt base oil typical of a Fischer-Tropsch synthesis or Gas to liquids (GTL).

FIG. 13 shows carbon labeling representation for a representative example of isomers of a GTL C30H62 paraffin used for lubricant applications.

DETAILED DESCRIPTION

Figure 1:
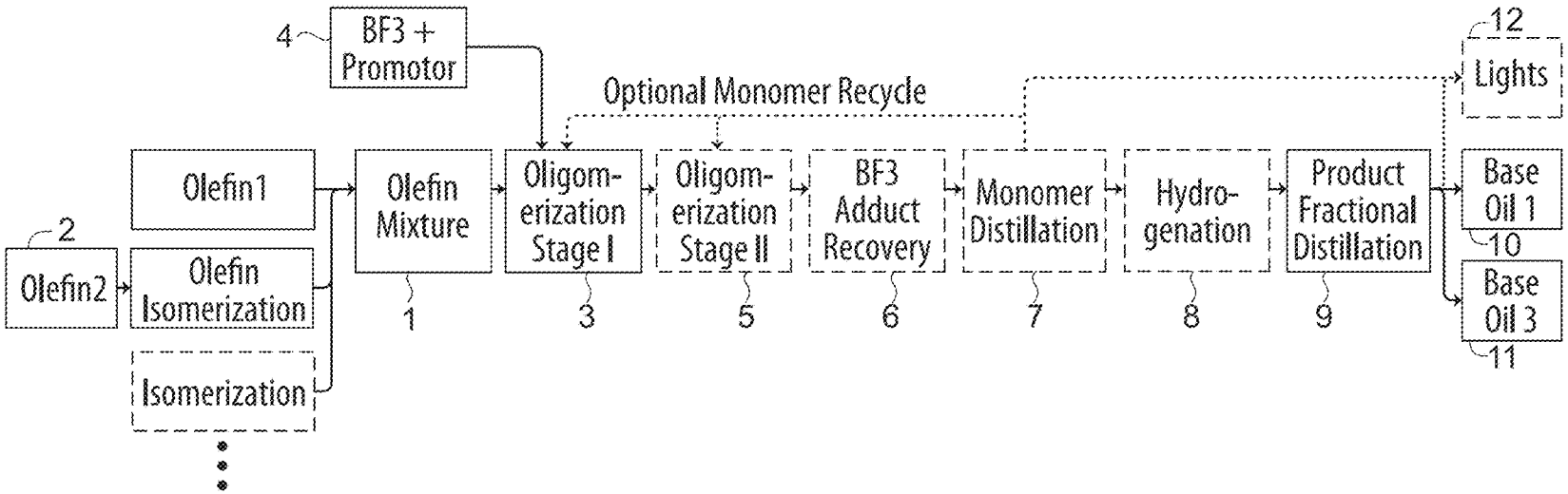
FIG. 1 shows a block diagram with a process embodiment including: preparation of an internal olefin feedstock by the catalytic isomerization of a linear alpha olefin forming at least a portion of the olefin feedstock, 1-stage oligomerization reaction with optional $2^{nd}$ stage, optional recycle of the unreacted monomer back into the $1^{st}$ stage of the oligomerization process, hydrogenation of the oligomers, and fractional distillation to separate the oligomers into 1 or more preferably 2 base oil distillate cuts and a bottoms product, and the optional distillation of an unsaturated or saturated monomer co-product.
Figure 2:
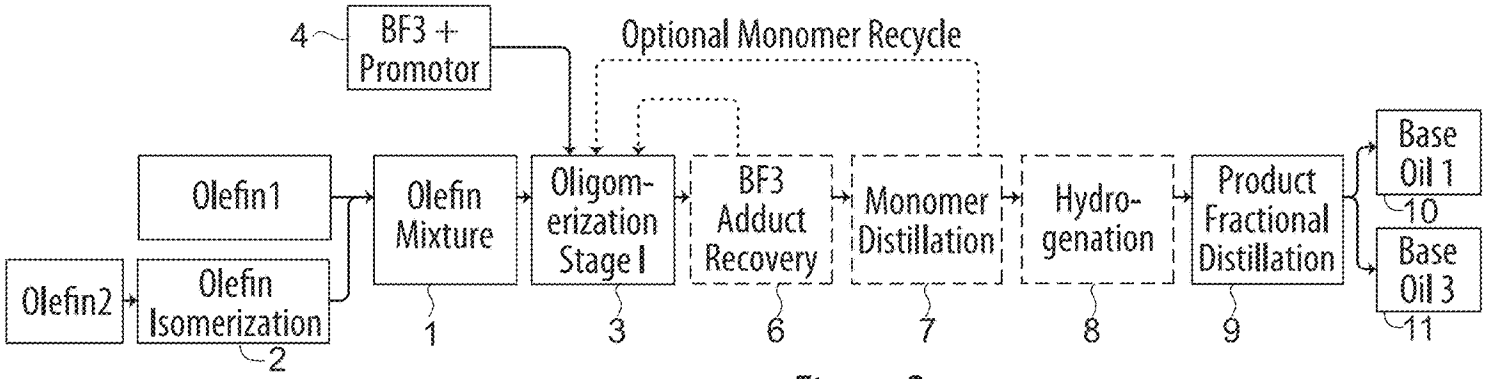
FIG. 2 shows a block diagram showing another process embodiment showing a single stage oligomerization with distillation of a unsaturated monomer co-product.

According to aspects of the disclosure, olefin oligomers are obtained by providing at least one C14-C18 olefin monomer, or a mixture of two or more of said olefins monomer, where at least one of the olefin monomer is an internal olefin monomer that has an average double bond position in the range of 1.5 to 5.0 (e.g., as shown in box 1 of FIGS. 1 and 2). The internal olefin monomer can be prepared from, for example, a C14-C18 alpha olefin monomer that has been subjected to isomerization, as shown in box 2 of FIGS. 1 and 2. The internal olefin can also be prepared by providing linear or branched internal olefins (such as C15-C18 branched internal olefin monomers), and optionally isomerizing to achieve the defined average double bond position. The internal olefin monomer having the defined average double bond position is oligomerized, for example either with itself, or with a second olefin, which may be an internal olefin monomer having a different chain length or different average double bond position, and/or may be a C14 to C18 alpha olefin monomer, such as a linear alpha-olefin monomer. In one embodiment, where one of the olefin monomers used to form the oligomer is a C14 olefin monomer, the other olefin monomer has a chain length greater than C14. For example, if C14 linear alpha olefin monomer is used as the second olefin monomer, the internal olefin comprises a C15 to C18 internal olefin monomer having the defined average double bond position. As shown in box 3 of FIGS. 1 and 2, said olefin mixture may be exposed to a catalyst such as Boron Trifluoride (box 4 of FIGS. 1 and 2), and an alcohol and/or ester promoter, to form an oligomer from the olefin monomer mixture. Optionally, a second stage reactor can be used to further react the olefin mixture under different reaction conditions as shown in box 5 of FIG. 1 (FIG. 2 shows a single-stage oligomerization). The $BF_3$ promotor adduct may be separated and recycled back to the oligomerization reactor as shown in box 6 of FIGS. 1 and 2. The unreacted monomer can be removed, and optionally recycled back into the starting olefin mixture, as shown in box 7 of FIGS. 1 and 2. The resulting mixture of oligomers is then hydrogenated, as shown in box 8 of FIGS. 1 and 2, and the dimer fraction may be separated therefrom, as shown in box 9 of FIGS. 1 and 2. A distillate with desirable physical properties for use in an engine oil formulation, such as properties suitable for 0W formulations, is shown in box 10 of FIGS. 1 and 2. A bottoms product may be recovered as shown in box 11 of FIGS. 1 and 2, suitable as a higher viscosity blend stock for engine oil applications or a base oil for higher viscosity industrial or other vehicle lubricants. Optionally a saturated or unsaturated lights co-product may be recovered as shown in box 12 of FIG. 1. In one embodiment, the resulting dimer may have a KV100 between 3.7 and 4.8 cSt, with a pour point between −27° C. and −45° C., with a CCS at −35° C. of less than 1800 cP, and a Noack volatility of less than 14%.

Other non-limiting examples of suitable Lewis acids that may be used for oligomerization and/or isomerization include metalloid halides and metal halides typically used as Friedel-Crafts catalysts, e.g. $AlCl_3$, $BF_3$, $BCl_3$, $AlBr_3$, $TiCl_3$, $TiCl_4$, $SnCl_4$, or $SbCl_5$. Any of the metalloid halide or metal halide catalysts can be used with or without a co-catalyst protic promoter (e.g. water, alcohol, acid, or ester). BF3 catalyst with a protic co-catalyst promoter can be used in any suitable amount.

For engine oil applications, in certain embodiments it may be important that the base oil have excellent viscometrics (e.g., high VI, >125) with a low enough pour point to allow the material to pass SAE 0W low temperature viscosity requirements in a formulated engine oil.

Feedstocks

According to one aspect, the feedstocks useful for making a dimer that has desirable viscosity for an engine oil are C14-C18 olefin monomers. Furthermore, aspects of the disclosure may require that at least one of the olefin monomers provided as the feedstock has an average double bond that is controlled to be at an average position in the range of from 1.5-5.0. The average double bond position can be measured by any conventional method, such as for example via a gas chromatography method. Furthermore, the internal olefin monomer having the defined average double bond position can be prepared, for example, through the isomerization of an alpha olefin, such as one that is derived from ethylene, see for example, U.S. Pat. No. 7,393,991 or from dehydrated alcohols, see for example U.S. Pat. No. 7,795,484. U.S. Pat. No. 7,393,991 details to the selective isomerization of alpha olefins to internal olefins by passing the olefin through a catalyst bed containing zeolite catalyst and/or montmorillonite catalyst at elevated temperatures. As disclosed herein, the average double bond position of the olefin monomer can be controlled to define the amount and length of branching present in the oligomer product.

In one embodiment, a first feedstock comprises a C14 to C18 internal olefin monomer. A second feedstock may also optionally be provided, which comprises at least one of a C14 to C18 alpha olefin monomer, and/or a C14 to C18 internal olefin monomer. For example, the first feedstock may be prepared by isomerizing at least a portion of C14 to C18 alpha olefin monomers under isomerization conditions suitable to generate an isomerized C14 to C18 alpha olefin product having an average double bond position in the range of from 1.5 to 5.0.

In another embodiment, the first feedstock is prepared by isomerization of C14 to C18 alpha olefin monomers selected from the group consisting of tetradecene, pentadecene, hexadecane, heptadecene and octadecene. In another embodiment, C14 to C18 alpha olefin monomers used to prepare the first feed stock (via isomerization thereof) are prepared by dehydration of C14 to C18 primary alcohols selected from the group consisting of 1-tetradecanol, 1-pentadecanol, 1-hexadecanol, 1-heptadecanol and 1-octadecanol. In yet another embodiment, C14 to C18 primary alcohols are converted to the C14 to C18 alpha olefin monomers, and isomerized to form the isomerized C14 to C18 olefin monomer of the first feed-stock product by exposure to a di-functional catalyst (e.g., a catalyst capable of both dehydrating the primary alcohols to form alpha olefin monomers, and isomerizing the alpha-olefin monomers to internal olefins.

In another embodiment, the feedstock used to form the C14 to C18 internal olefin monomers comprises less than 20% by weight of branched olefin monomers. In yet another embodiment, the feedstock used to form the C14 to C18 internal olefin monomers comprises less than 10% by weight of branched olefin monomers. In yet another embodiment, the feedstock used to form the C14 to C18 internal olefin monomers comprises less than 5% by weight of branched olefin monomers.

Furthermore, in another embodiment, an amount of decene in any of the first and/or second feedstocks is less than 10% by weight. In yet another embodiment, an amount of decene in any of the first and/or second feedstocks is less than 5% by weight.

In yet another embodiment, the isomerization conditions used to form the internal olefin monomers of the first feedstock comprise heating C14 to C18 alpha olefin monomers in the presence of an isomerization catalyst to a temperature in a range of from 100 to 400° C. In yet another embodiment, isomerization conditions comprise heating C14 to C18 alpha olefin monomers in the presence of an isomerization catalyst in a fixed bed reactor with a liquid hourly space velocity (LHSV) of 0.5-2 $h^{-1}$ In yet another embodiment, isomerization of at least a portion of the C14 to C18 alpha olefin monomers comprises heating the monomers in the presence of an isomerization catalyst selected from the group consisting of activated alumina, gamma-alumina, zirconium oxide on gamma alumina, theta-alumina with or without the presence of alkali metal.

In another embodiment, the isomerization conditions result in greater than 30% conversion of the C14 to C18 olefin alpha olefin monomers to C14-C18 internal olefin monomers. In another embodiment, the isomerization conditions result in greater than 50% conversion of the C14 to C18 olefin alpha olefin monomers to C14-C18 internal olefin monomers. In yet another embodiment, the isomerization conditions result in greater than 60% conversion of the C14 to C18 olefin alpha olefin monomers to C14-C18 internal olefin monomers. In yet a further embodiment, the isomerization conditions result in greater than 70% conversion of the C14 to C18 olefin alpha olefin monomers to C14-C18 internal olefin monomers. In a further embodiment, the isomerization conditions result in greater than 80% conversion of the C14 to C18 olefin alpha olefin monomers to C14-C18 internal olefin monomers. In yet another embodiment the isomerization conditions result in greater than 90% conversion of the C14 to C18 olefin alpha olefin monomers to C14-C18 internal olefin monomers.

In yet another embodiment, the average double bond position of the isomerized C14 to C18 olefin monomer product is in the range of from 1.5 to 5.0. In yet another embodiment, the average double bond position of the isomerized C14 to C18 olefin monomer product is in the range of from 1.5 to 4.5. In yet another embodiment, the average double bond position of the isomerized C14 to C18 olefin monomer product is in the range of from 2.0 to 4.4. In yet another embodiment, the average double bond position of the isomerized C14 to C18 olefin monomer product is in the range of from 2.5 to 4.2. In yet another embodiment, the average double bond position of the isomerized C14 to C18 olefin monomer product is in the range of from 3.0 to 4.0. In yet another embodiment, the average double bond position of the isomerized C14 to C18 olefin monomer product is in the range of from 3.5 to 3.9.

Renewable Feedstocks

In some variations, about 100% of the carbon atoms in the olefin feedstocks described herein may originate from renewable carbon sources. In some variations, about 100% of the carbon atoms in the olefin co-monomer (e.g., the second feedstock) originate from renewable carbon sources. For example, an alpha-olefin co-monomer may be produced by oligomerization of ethylene derived from dehydration of ethanol produced from a renewable carbon source. In some variations, an alpha-olefin co-monomer may be produced by dehydration of a primary alcohol other than ethanol that is produced from a renewable carbon source. Said renewable alcohols can be dehydrated into alpha olefins, or isomerized simultaneously to a desired average double bond position using gamma alumina as a di-functional catalyst. In some embodiments, hydrocarbon terpene feedstocks derived from renewable resources are coupled with one or more olefins that are derived from renewable resources.

In one embodiment, at least one of the first and second feedstocks comprises at least 1% by weight of a terpene. In yet another embodiment, at least one of the first and second feedstocks comprises at least 5% by weight of a terpene. In yet another embodiment, at least one of the first and second feedstocks comprises at least 10% by weight of a terpene. In yet another embodiment, at least one of the first and second feedstocks comprises at least 20% by weight of a terpene. In yet another embodiment, at least one of the first and second feedstocks comprises at least 30% by weight of a terpene. In yet another embodiment, at least one of the first and second feedstocks comprises at least 40% by weight of a terpene. In yet another embodiment, at least one of the first and second feedstocks comprises at least 50% by weight of a terpene.

Oligomerization Conditions

The present disclosure relates to a method for making saturated C28-C36 hydrocarbon dimers, suitable for use as lubricant base oils.

According to one embodiment of a process of forming the dimer composition, a first feed stock comprising an isomerized C14 to C18 olefin monomer is oligomerized, either by oligomerization with itself or optionally with a second feedstock comprising at least one of C14 to C18 alpha olefin monomers and/or C14 to C18 internal olefin monomers, to produce an oligomer product comprising dimers, trimers, and higher oligomers. In one embodiment, the second feedstock comprises internal olefin monomers prepared by a manner that is the same as and/or similar to the isomerization methods used to prepare the isomerized olefin product of the first feedstock, and/or may be provided by a different method. The second feedstock may have the same or a different chain length than the first feedstock, and/or may have internal olefin monomers with the same or different average double bond position (or may be alpha olefin monomers). In one embodiment, when the second feedstock is a C14 alpha olefin, the first feedstock comprises olefin monomers having at least one more carbon for the carbon chain length, such as C15 to C18 olefin monomers.

In another embodiment of a method of preparing the base oil, in an oligomerization process, an alpha olefin (e.g., 1-tetradecene) is mixed with an alpha or internal olefin (e.g., hexadecene internal olefin having the defined average bond position) polymerized either by semi-batch or continuous mode in a single stirred tank reactor or by continuous mode in a series of stirred tank reactors using for example $BF_3$ and/or $BF_3$ promoted with a mixture of linear alcohol and an alkyl acetate ester under reaction conditions which impart a controlled amount of isomerization during the oligomerization process to produce a branched unsaturated oligomer.

In another embodiment, the internal olefin monomer C14 to C18 isomerized product is oligomerized with a second feedstock, the second feedstock comprising C14 to C18 internal olefin monomers. In yet another embodiment the internal olefin monomer C14 to C18 isomerized product is oligomerized with a second feedstock, the second feedstock comprising C14 to C18 alpha olefin monomers including one or more of linear and branched alpha olefins. In yet another embodiment, the internal olefin monomer C14 to C18 isomerized product is oligomerized with a second feedstock comprising C14 to C18 alpha olefins including branched olefins in a content by weight of up to 36% by weight of the C14 to C18 alpha olefins. In yet another embodiment, the internal olefin monomer C14 to C18 isomerized product is oligomerized with a second feedstock comprising C14 to C18 alpha olefins including branched olefins in a content by weight of up to 25% by weight of the C14 to C18 alpha olefins. In yet another embodiment, the internal olefin monomer C14 to C18 isomerized product is oligomerized with a second feedstock comprising C14 to C18 alpha olefins including branched olefins in a content by weight of up to 15% by weight of the C14 to C18 alpha olefins. In yet another embodiment, the internal olefin monomer C14 to C18 isomerized product is oligomerized with a second feedstock comprising C14 to C18 alpha olefins including branched olefins in a content by weight of up to 5% by weight of the C14 to C18 alpha olefins.

In another embodiment, the internal monomer olefin C14 to C18 isomerized product is isomerized with a second feedstock comprising C14 to C18 alpha olefin monomers in a ratio by weight of the internal monomer olefin C14 to C18 product to the C14 to C18 alpha olefin monomers in a range of from 80:20 to 20:80. In yet another embodiment, the internal monomer olefin C14 to C18 isomerized product is oligomerized with a second feedstock comprising C14 to C18 alpha olefin monomers in a ratio by weight of the internal monomer C14 to C18 product to the C14 to C18 alpha olefin monomers in a range of from 70:30 to 50:50.

In another embodiment, the internal monomer olefin C14 to C18 isomerized product is oligomerized with a second feedstock comprising C14 to C18 olefin monomers having a different chain length than the internal monomer olefin C14 to C18 isomerized olefin monomer product. In yet another embodiment, the internal monomer olefin C14 to C18 isomerized monomer product comprises C16 to C18 internal olefin monomers, and is oligomerized with a second feedstock comprising C14 alpha olefin monomers. In another embodiment, the internal monomer olefin C14 to C18 isomerized product comprises C16 internal olefin monomers, and is oligomerized with a second feedstock comprising C14 alpha olefins to form the oligomer product. In yet another embodiment, the internal monomer olefin C14 to C18 isomerized product comprises C16 internal olefin monomers, and the C16 internal olefin monomers are oligomerized with each other or a second feedstock comprising C16 olefin monomers to form the oligomer product.

In yet another embodiment, oligomerization is performed using a boron trifluoride oligomerization catalyst, an alcohol promoter, and an ester promoter in at least one continuously stirred reactor under oligomerization conditions. In yet another embodiment, the oligomerization reaction is performed at a temperature in the range of from 15° C. to 110° C. In yet another embodiment, the oligomerization reaction is performed at a temperature in the range of from 20° C. to 110° C. In a further embodiment, the oligomerization reaction is performed at a temperature in the range of from 40° C. to 110° C. In yet a further embodiment, the oligomerization reaction is performed at a temperature in the range of from 60° C. to 110° C. In yet a further embodiment, the oligomerization reaction is performed at a temperature in the range of from 80° C. to 110° C. In another embodiment, the oligomerization reaction is performed at a temperature in the range of from 90° C. to 110° C. In yet another embodiment, the oligomerization reaction is performed at a temperature in the range of from 90° C. to 100° C. In one embodiment, the oligomerization is performed using a continuously stirred tank reactor. In yet another embodiment, the average residence time of oligomers in a continuously stirred tank reactor is in the range from 60 to 400 minutes. In another embodiment, the average residence time of oligomers in a continuously stirred tank reactor is in the range from 90 to 300 minutes. In a further embodiment, the average residence time of oligomers in a continuously stirred tank reactor is in the range of from 120 to 240 minutes. In another embodiment, an average residence time of oligomers in a continuously stirred tank reactor is in the range from 150 to 240 minutes. In yet another embodiment, the average residence time of oligomers in a continuously stirred tank reactor is in the range from 180 to 240 minutes.

In yet another embodiment invention, the reaction mixture is distilled to remove the unreacted monomer. For example, the unreacted monomer may be separated from the oligomer product, such as via distillation, and can be recycled back into the mixture of the first and/or second feedstocks for oligomerization thereof.

In a further embodiment, the oligomer product is hydrogenated to form a saturated oligomer product comprising a mixture of branched saturated hydrocarbons including hydrogenated dimer, trimer, and higher oligomers. According to one aspect, the mixture of branched saturated hydrocarbons is hydrogenated to the extent that the Bromine Index is below 1000 mg $Br_2$/100 g, as measured by ASTM D2710-09.

The hydrogenated dimer can be separated from the saturated oligomer product, such as via distillation or other separation method. In one embodiment, the saturated oligomer product is fractionated by distillation to produce two or more base oil lubricant fractions. The one or more fractions comprising the hydrogenated dimer may be used as a base oil having advantageous properties as described herein. Furthermore, controlling the different parameters of said oligomerization can have large effect on the physical properties of the resulting oligomers. For example, in one embodiment, the oligomerization process may be performed under conditions to further at least partially isomerize olefin monomers in one or more of the first and second feedstock. For example, the oligomerization process may be performed in the presence of a catalyst, and under oligomerization conditions, that further promote one or more of isomerization of the double-bond in an olefin monomer and/or a skeletal isomerization of the oligomer product and/or olefin monomer. In yet another embodiment, parameters of the oligomerization process are controlled to promote the thermal and oxidative stability of the base oil. For example, in one embodiment, the parameters of the oligomerization process may be controlled such that the oligomerization product comprises less than 0.5 wt. % of benzylic groups formed as oligomerization by-products, and may even be substantially free of such benzylic groups.

Base Oil

According to embodiments of the disclosure, a base oil comprising dimers of C14-C18 olefin monomers is provided, which base oil can exhibit improved properties such as reduced Noack Volatility and cold temperature properties that may be suitable for automotive engine oil applications as well as other uses. In particular, as described herein, the dimers of the C14-C18 olefin monomers are prepared by oligomerizing at least one feedstock comprising internal olefin monomers, where the internal olefin monomers have a defined average double bond position. For example, olefin monomers such as alpha olefins may be subjected to a controlled isomerization process that results in isomerization of the position of the olefin double bond to the defined average position, and the resulting oligomer product obtained via oligomerization of the isomerized olefin monomers provides a branched hydrocarbon product including branched dimers, trimers, and higher oligomers. The branched dimers can be used to form the base oil having the improved properties.

Accordingly, in one embodiment, the saturated hydrocarbon base oil comprises dimers of C14-C18 olefin monomers, with the dimers having an average carbon number in the range of from 29 to 36 For example, in one embodiment the saturated hydrocarbon base oil may comprise a dimer of a C14 and a C16 olefin monomer. In yet another embodiment, the saturated hydrocarbon base oil may comprise a dimer of a C16 olefin monomer with another C16 olefin monomer. Other combinations of any of C14, C15, C16, C17 and C18 olefin monomers may also be provided. At least one of the olefin monomers forming the dimers is an olefin monomer that is an internal olefin monomer having the defined average double bond position, such as an olefin monomer that has been subjected to isomerization to provide internal olefin monomers with an average double bond position that is within a defined range. In one embodiment, the dimer is formed from the oligomerization of an internal olefin monomer having the defined average double bond position with an alpha olefin. In yet another embodiment, the dimer is formed from oligomerization of an internal olefin monomer having the defined average double bond position with itself. In yet another embodiment, the dimer is formed from oligomerization of an internal olefin monomer having the defined average double bond position with a second internal olefin monomer having the same or a different average double bond position.

The dimers further comprise an average carbon number corresponding to the total number of carbon atoms in the dimer resulting from the combination of olefin monomers, with the average carbon number being in the range of from 29 to 36. For example, a dimer product of C14 and C16 olefin monomers would result in an average carbon number of least 30 (14+16). Similarly, a dimer product of C16 and C16 olefin monomers would result in an average carbon number of at least 32 (16+16). A dimer product of C14 and C18 olefin monomers would similarly result in an average carbon number of 32 (14+18). Accordingly, the olefin monomers that are selected to prepare the dimer product are chosen such that the final dimer product has an average total number of carbon atoms that within the range of from 29 to 36.

The base oil having the improved properties according to aspects of the disclosure further comprises the dimers as a significant percent by weight of the base oil composition. For example, the dimers may make up at least 50% by weight and even at least 80% by weight, such as 90% by weight and even 95% by weight of the composition of the base oil, and may even make up at least 98% by weight and even at least 99% by weight of the composition of the base oil.

According to one embodiment, an extent and type of branching that occurs in the dimers can be characterized according to one or more of a Branching Index, Branching Ratio, and Paraffin Branching Proximity of the dimer product, as these terms are defined herein. Generally speaking, the Branching Index and the Branching Ratio are related to the relative number of branch termination points in the dimer, whereas the Paraffin Branching Proximity is related to the average number of repeat carbon atoms in the resulting branched chains of the branched dimers. As defined further herein, the Branching Index and Branching Ratio for the dimer can be determined by 1H NMR techniques (BI and BR) or IR techniques (BR), where the Branching Index is calculated by taking the ratio of the total number of methyl hydrogens to the total number of hydrogens in the dimer ($CH_3/(CH_3+CH_2+CH)$), where the hydrogens that are being counted are also non-benzylic hydrogens and the Branching Ratio is calculated by taking the ratio of methyl groups to methylene groups by 1H NMR or IR. That is, the Branching Index of the dimer may be defined according to formula (1) below:

$$\text{Branching Index (BI)}=(\text{number of methyl group hydrogens/total number of hydrogens})*100, \quad (1)$$

and the Branching Ratio (BR) may be defined according to formula (2) below:

$$\text{Branching Ratio (BR)}=(\text{methyl groups})/(\text{methylene groups}). \quad (2)$$

According to one embodiment, the average branching index (BI) of the dimer product is at least 22, such as in the range of from 22 to 26.

Referring to FIG. 9, a process for preparing a dimer product is shown where isomerization has been performed, and a dimer formed from C14 and C16 olefin monomers. As shown in FIG. 9, the resulting dimer has an average Branching Index (BI) and an average Branching Ratio (BR) that are higher than what would result without the isomerization process (e.g., as shown in the comparative dimer preparation process, without isomerization pre-oligomerization, shown in FIG. 10). The average Branching Index (BI) as calculated by taking the ratio of the total number of methyl hydrogens to the total number of hydrogens ($CH_3$, $CH_2$ and CH hydrogens)*100, is greater than 22 (i.e., within the range of from 22 to 26). In contrast, referring to FIG. 10, dimers formed by oligomerization of an alpha C16 olefin monomer with an alpha C14 olefin monomer is shown, without performing any isomerization. For this dimer product, the average Branching Index (BI) for the two structures shown is the average of the BI for the top dimer, which is 9/62*100=14.5 and the BI for the bottom dimer, which is 12/62*100=19.4, resulting in an average BI (assuming equal amounts of each dimer) of about 17 (e.g., less than 22, and even less than 19).

Similarly, referring to FIG. 11, which depicts an embodiment of a trimer prepared from decene alpha olefin monomers, it can be seen that the branching index is only 19.4 (e.g., less than 22). Referring to FIG. 12 which depicts an embodiment of a base oil prepared in a Fischer-Tropsch synthesis of gas to liquids (GTL), it can be seen that the Branching Index (BI) is also only 19.4 (e.g., less than 22). Accordingly, the base oil comprising the dimer product prepared via isomerization of an olefin monomer (e.g., as in FIG. 9) exhibits an average Branching Index (BI) that is greater than that of various prior products, including decene trimer products (FIG. 11) and Fischer-Tropsch synthesis products (FIG. 12), as well as an average Branching Index (BI) that is greater than that of the same dimer product prepared without any isomerization step (e.g., as in FIG. 10).

As yet another measure of the extent and/or type of branching that occurs in the dimer product of the base oil, the paraffin branching proximity (BP) can be understood as a measure of the % equivalent recurring methylene carbons that are five or more removed from an end group or a branch of the dimer product (e.g., c carbon groups), and thus is related to the average length of carbon chains in the dimer product. The Branching Proximity can be determined according to a 13C NMR technique, and may be calculated according to the following formula:

paraffin Branching Proximity (BP)=(number of ε carbon groups/total number of carbon groups) *100, An ε carbon group in the formula is defined as a carbon group that is separated from any terminal carbon atom groups or branching carbon groups by at least 4 carbon groups. In one embodiment, the branching proximity for the dimer product may be in the range of from 18 to 26, such as in the range of from 20 to 24. For Example, referring to FIG. 12, a GTL C30H62 paraffin is shown, with ε carbon groups shown, as well as α, β, γ and δ carbon groups. The α carbon groups are those directly adjacent to either a terminal carbon group or branching carbon group (4α carbon groups in FIG. 12). Moving down the carbon chain away from the terminal carbon groups or branching carbon groups, the β carbon groups are adjacent to the α carbon groups, the γ carbon groups are adjacent to the β carbon groups, and the δ carbon groups are adjacent to the γ carbon groups. Accordingly, the ε carbon groups are any carbon groups other than these α, β, γ and δ, i.e. any carbon groups that are 4 or more carbon groups away from terminal and/or branching carbons. The paraffin Branching Proximity thus provides a measure related to the length of carbon chains in between the branching and/or terminal carbon groups.

In one embodiment, the average paraffin branching proximity (BP) for the dimer product, as determined by 13C NMR, is no more than 26, and may also be at least 18, such as in a range of from 18 to 26. Referring to the dimer product in FIG. 9, produced via isomerization and oligomerization of C16 and C14 olefin monomers, it can be seen that the product has an average paraffin branching proximity of greater than 18. In contrast, the dimer product of FIG. 10, produced by oligomerization without isomerization, exhibits an average paraffin branching proximity of greater than 26 (i.e., outside the range of from 18 to 26). Similarly, the decene trimer depicted in FIG. 11 exhibit a paraffin branching proximity of 3 (i.e., less than the range of 18 to 26), and the base oil produced by Fischer-Tropsch synthesis of FIG. 12 exhibits a paraffin Branching Proximity (BP) of 26.7 (i.e., greater than the range of 18 to 26).

According to one embodiment, the saturated hydrocarbon base oil comprising the dimer product exhibits improved properties, such as volatility and cold temperatures properties suitable for use in automotive engine oil formulations. In one embodiment, the saturated hydrocarbon base oil comprising the dimer product exhibits a Noack Volatility as measured by ASTM D5800 that is less than 14%. In yet another embodiment, the saturated hydrocarbon base oil comprising the dimer product exhibits a Noack Volatility as measured by ASTM D5800 that is less than 13%. In yet another embodiment, the saturated hydrocarbon base oil comprising the dimer product exhibits a Noack Volatility as measured by ASTM D5800 that is less than 12%. In yet another embodiment, the saturated hydrocarbon base oil comprising the dimer product exhibits a Noack Volatility as measured by ASTM D5800 that is less than 11%. In yet another embodiment, the saturated hydrocarbon base oil comprising the dimer product exhibits a Noack Volatility as measured by ASTM D5800 that is less than 10%. In yet another embodiment, the saturated hydrocarbon base oil comprising the dimer product exhibits a Noack Volatility as measured by ASTM D5800 that is less than 9%. In yet another embodiment, the saturated hydrocarbon base oil comprising the dimer product exhibits a Noack Volatility as measured by ASTM D5800 that is less than 8%. In yet another embodiment, the saturated hydrocarbon base oil comprising the dimer product exhibits a Noack Volatility as measured by ASTM D5800 that is less than 7%. Generally, the Noack Volatility will be at least 6%.

According to yet another embodiment, the saturated hydrocarbon base oil comprising the dimer product exhibits a Pour Point as measured by ASTM D97 of no greater than −27° C. According to yet another embodiment, the saturated hydrocarbon base oil comprising the dimer product exhibits a Pour Point as measured by ASTM D97 of no greater than −30° C. According to one embodiment, the Pour Point as measured by ASTM D97 will be no greater than −33° C. as measured by ASTM D97. According to yet another embodiment, the saturated hydrocarbon base oil comprising the dimer product exhibits a Pour Point as measured by ASTM D97 of no greater than −36° C. According to yet another embodiment, the saturated hydrocarbon base oil comprising the dimer product exhibits a Pour Point as measured by ASTM D97 of no greater than −39° C. According to yet another embodiment, the saturated hydrocarbon base oil comprising the dimer product exhibits a Pour Point as measured by ASTM D97 of no greater than −42° C.

According to one embodiment, the saturated hydrocarbon base oil comprising the dimer product exhibits a Cold Crank Simulated (CCS) dynamic viscosity as measured by ASTM D5293 at −35° C. of 1800 cP or less. According to yet another embodiment, the saturated hydrocarbon base oil comprising the dimer product exhibits a Cold Crank Simulated (CCS) dynamic viscosity as measured by ASTM D5293 at −35° C. of 1700 cP or less. According to yet another embodiment, the saturated hydrocarbon base oil comprising the dimer product exhibits a Cold Crank Simulated (CCS) dynamic viscosity as measured by ASTM D5293 at −35° C. of 1600 cP or less. According to yet another embodiment, the saturated hydrocarbon base oil comprising the dimer product exhibits a Cold Crank Simulated (CCS) dynamic viscosity as measured by ASTM D5293 at −35° C. of 1500 cP or less. According to yet another embodiment, the saturated hydrocarbon base oil comprising the dimer product exhibits a Cold Crank Simulated (CCS) dynamic viscosity as measured by ASTM D5293 at −35° C. of 1400 cP or less. According to yet another embodiment, the saturated hydrocarbon base oil comprising the dimer product exhibits a Cold Crank Simulated (CCS) dynamic viscosity as measured by ASTM D5293 at −35° C. of 1300 cP or less. According to yet another embodiment, the saturated hydrocarbon base oil comprising the dimer product exhibits a Cold Crank Simulated (CCS) dynamic viscosity as measured by ASTM D5293 at −35° C. of 1200 cP or less. In general, the Cold Crank Simulated (CCS) dynamic viscosity as measured by ASTM D5293 at −35° C. will be a least 1100 cP.

According to one embodiment, the saturated hydrocarbon base oil comprising the dimer product exhibits a kinematic viscosity (KV100) as measured by ASTM D445 in the range of from 3.7 to 4.8. According to another embodiment, the saturated hydrocarbon base oil comprising the dimer product exhibits a kinematic viscosity (KV100) as measured by ASTM D445 in the range of from 3.7 to 4.5. According to another embodiment, the saturated hydrocarbon base oil comprising the dimer product exhibits a kinematic viscosity (KV100) as measured by ASTM455 in the range of from 3.8 to 4.4. According to another embodiment, the saturated hydrocarbon base oil comprising the dimer product exhibits a kinematic viscosity (KV100) as measured by ASTM D445 in the range of from 3.9 to 4.3. According to another embodiment, the saturated hydrocarbon base oil comprising the dimer product exhibits a kinematic viscosity (KV100) as measured by ASTM D445 in the range of from 4.0 to 4.2.

According to one embodiment, the saturated hydrocarbon base oil comprising the dimer product exhibits a Viscosity Index (VI) as measured by ASTM D445 that is greater than 125. According to another embodiment, the saturated hydrocarbon base oil comprising the dimer product exhibits a Viscosity Index (VI) as measured by ASTM D445 that is greater than 130. According to another embodiment, the saturated hydrocarbon base oil comprising the dimer product exhibits a Viscosity Index (VI) as measured by ASTM D445 that is greater than 135. According to another embodiment, the saturated hydrocarbon base oil comprising the dimer product exhibits a Viscosity Index (VI) as measured by ASTM D445 that is greater than 140. Generally, the Viscosity Index (VI) as measured by ASTM D445 will be less than 150.

As another example, in one embodiment, the saturated hydrocarbon base oil comprising the dimer product exhibits a Noack Volatility of less than 14%, a Pour Point no greater than −27° C., and a CCS at −35° C. that is less than 1900 cP. Furthermore, in one embodiment, the saturated hydrocarbon base oil comprising the dimer product exhibits a Viscosity Index that is greater than 125, and a KV(100) that is in the range of from 3.7 to 4.8, such as in the range of from 3.7 to 4.5.

In yet another embodiment, the saturated hydrocarbon base oil comprising the dimer product exhibits a Cold Crank Simulated (CCS) dynamic viscosity at −35° C. that is related to the value of the KV(100) for the saturated hydrocarbon base oil. Specifically, the CCS dynamic viscosity may be a value which is less than or equal to the value of the following equation:

$$-14.167(KV100)^2+107.42(KV100)-190$$

The relationship between the CCS dynamic viscosity values and KV(100) is discussed in more detail below.

In yet further embodiment, the saturated hydrocarbon base oil comprising the dimer product exhibits a Noack Volatility that is related to the value of the KV(100) for the saturated hydrocarbon base oil. Specifically, the Noack Volatility may be a value which is less than or equal to the value of the following equation:

$$-1583.3(KV100)^2+13858(KV100)-28500$$

The relationship between the Noack Volatility values and KV(100) is discussed in more detail below.

In one embodiment, the saturated hydrocarbon base oil comprises less than 10% of dimers containing singularly branched isomers, according to the simulated distillation test ASTM D2887. According to another embodiment, the saturated hydrocarbon base oil comprises less than 5% of dimers containing singularly branched isomers, according to the simulated distillation test ASTM D2887. The saturated hydrocarbon base oil comprises less than 1% of dimers containing singularly branched isomers, according to the simulated distillation test ASTM D2887 is discussed in more detail below.

Temperature Isomerization Effect

Temperature variation tables (1 and 2 below) illustrate the effect of oligomerization temperature on dimer products, according to one aspect of the disclosure. Generally, increasing the oligomerization temperature increases the amount of isomerization that occurs during $BF_3$ catalyzed oligomerization. Comparative example A is a sample of C14 dimers made at relatively low oligomerization temperature, with little isomerization taking place during oligomerization. Comparative examples B and C show the physical property changes of the product when C14 is dimerized at the relatively higher temperatures of 60 and 80° C. respectively. As shown in these Comparative Example, larger amounts of branched isomers reduce an oligomer's pour point, while simultaneously decreasing the VI and increasing the CCS@ −35° C. Accordingly, proper balance of the isomerization, including isomerization pre-oligomerization as well as any isomerization occurring during oligomerization, may be controlled to obtain optimal engine oil properties for dimers derived from long chain olefins (C14-C18)

TABLE 1

Oligomerization Temperature Effect on C14 Dimer Properties.

| Example | C14% | C16% | C14 avg DBP | Temp ° C. | KV 100 | VI | CCS @−35 | PP | Noack % |
|---|---|---|---|---|---|---|---|---|---|
| Comparative example A | 100 | 0 | 1 | 19 | 3.01 | 134 | 688 | −30 | 16.1 |
| Comparative example B | 100 | 0 | 1 | 60 | 3.36 | 130 | 740 | −36 | 17.6 |
| Comparative example C | 100 | 0 | 1 | 80 | 3.40 | 122 | 831 | −39 | 19.0 |

C14 Only Dimers with Changes in Oligomerization Temperature

The C28 molecules from C14-only dimers seen in table (1) have significantly lower viscosity and boiling point distribution than the traditional C30 chain length molecules used for engine oils. This results in a Noack volatility that is too high to be desirable as an 0W engine oil alone. Surprisingly, it has been discovered that, according to one aspect, combining C14 olefin monomers with a longer chain olefin can provide a base oil having desirable properties, as is shown in more detail below (see, e.g., table 3). According to one aspect, the C14 olefin monomers are reacted in a predetermined ratio with C16 olefin monomers. For example, the reaction mixture can comprise C14 olefin in less than or equal to 50% of the olefin mixture. In another embodiment, the reaction mixture can comprise of less than 40% of C14 olefin monomers. In another embodiment, the reaction mixture can comprise of less than 35% of C14 olefin monomers. Isomerization of one or more olefin monomers can be performed prior to oligomerization, and/or the olefin feed can be reacted under specified reaction conditions to induce oligomer isomerization, as discussed in more detail below. According to one embodiment, using an oligomerization temperature greater than 18° C. In another embodiment, using an oligomerization temperature greater than 50° C. In another embodiment, using an oligomerization temperature greater than 80° C. In another embodiment, using an oligomerization temperature greater than 90° C. and even greater than 100° C., enables the oligomers to obtain desirable engine oil properties as seen in Examples 1 through 6 in table 3 below.

Furthermore, the C32 molecules from C16 LAO seen in table (2) have a higher viscosity and boiling point distribution than the traditional C30 chain length molecules used for engine oils. Comparative Example D is a dimer of C16 alpha olefin that was oligomerized at 30° C. with little isomerization occurring during oligomerization. This results in pour point and CCS @ −35° C. that are too high to be desirable as an 0 w engine oil alone. However, the higher boiling point of the C32 does advantageously reduce the Noack volatility. Comparative Example E is a dimer of C16 alpha olefins oligomerized at a relatively high temperature, such that significant isomerization occurred during the oligomerization. While isomerization during oligomerization improved cold temperature properties of C16 alpha olefin dimers, in this instance it did not provide the correct branching necessary to yield the cold temperature viscometrics desirable for engine oils.

Double Bond Isomerization

Accordingly, while proper balancing of the ratios of 1-tetradecene (C14) and longer chain length alpha olefins can solve the volatility issue of the tetradecene dimer, it did not produce dimers with superior low temperature properties. The linearity of the long chain LAO dimers tends to produce dimers with a higher pour point, as shown in comparative example F in table 3 below. Accordingly, it has been discovered that additional branching is needed to achieve desired cold flow properties. Specifically, according to one aspect, it has been discovered that one way of controlling branching, such as by introducing appropriate length of the branches in the product, is by controlling the average double bond position in the olefin monomer(s) used as the olefin feed for a given oligomerization. Increasing the average double bond position will increase the size of the branches present within the oligomer. A further unexpected finding is that olefin feeds having an average double bond position of about 2.5-3.5 are more susceptible and may experience excess isomerization as shown in example 2 and 3 in table 3, at elevated oligomerization temperatures, than those olefins with higher or lower average double bond positions. Olefins with an even higher average double bond position, such as about 3.6 or greater, can also yield desirable branching when oligomerization occurs at an elevated temperature, to promote the desired degree of further isomerization. For example, the base oil resulting from oligomerization at about 100° C. of, olefins having a double bond position of about 3.6, exhibit excellent cold temperature viscometrics, reduced CCS @ −35° C. and a sufficiently low pour point. Furthermore, according to one aspect, good base oil properties can also be obtained with olefin feeds having average double bond position lower than about 3.6, by making adjustments to the oligomerization temperature. For example, using an olefin feed with a 2.5-3.5 average double bond position, an oligomerization temperature less than 100° C. will reduce the isomerization of the oligomers, and yield base oils with a CCS @ −35° C. below 1800 cP, seen in table 3 as example 6. As shown in table 3 below C16 olefins between 2.5-3.5 average double bond position yield preferable results when oligomerized at temperatures below 100° C., and olefins with an average double bond position above 3.6 yield preferred properties when oligomerized at 100° C. or greater.

TABLE 2

Oligomerization Temperature Effect on C16 only Dimers. Does not produce correct branching for ideal cold temperature viscometrics.

| sample | C14% | C16% | Temp ° C. | KV 100 | VI | CCS@−35 | PP | Noack % |
|---|---|---|---|---|---|---|---|---|
| Comparative Example D | 0 | 100 | 30 | 4.298 | 151 | NM* | −15 | 6.4 |
| Comparative Example E | 0 | 100 | 100 | 4.43 | 136 | 2914 | −18 | 8.4 |

*Not measurable - CCS at −35° C. could not be determined for this sample

TABLE 3

Average Double Bond Position Changes

| Example # | C14 Avg DBP | C16 Avg DBP | Olig Temp | KV100 | VI | CCS@−35° C. | Pour Point ° C. | Noack % |
|---|---|---|---|---|---|---|---|---|
| Comparative example F | 1 | 1 | 100 | 4.13 | 128 | 1819 | −27 | 12.6 |
| Example 1 | 1 | 1.76 | 100 | 4.21 | 128 | 1889 | −33 | 11.8 |
| Example 2 | 1 | 2.54 | 100 | 4.15 | 122 | 1848 | −42 | 12.3 |
| Example 3 | 1 | 3.15 | 100 | 4.24 | 120 | 2005 | −45 | 12.1 |
| Example 4 | 1 | 3.85 | 100 | 4.00 | 132 | 1469 | −33 | 12.5 |
| Example 5 | 1 | 4.21 | 100 | 4.14 | 127 | 1642 | −33 | 11.6 |
| Example 6 | 1 | 2.7 | 90 | 4.04 | 132 | 1593 | −36 | 12.2 |

Description of Average Double Bond Analysis

As seen in table 3, the average double bond position of the isomerized olefin allows for control of the properties of the resulting oligomers, to advantageous effect. That is, simply controlling the ratio of alpha- to internal-olefins in the olefin feed is not sufficient to obtain the optimal base oil properties (see, e.g., U.S. Pat. No. 4,910,355).

Figure 3:
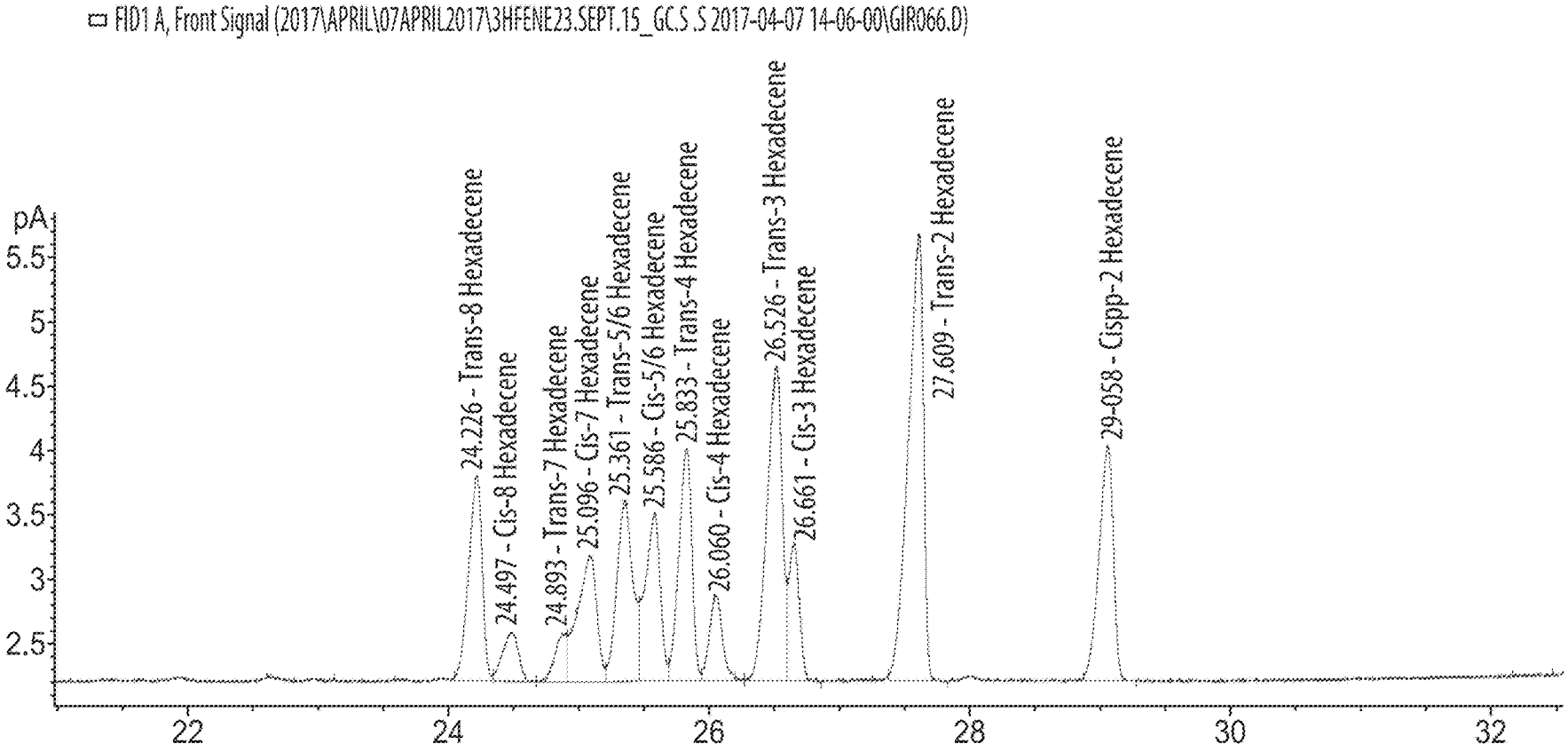
FIG. 3 shows a gas chromatography trace of an embodiment of an isomerized hexadecane olefin. The Trans and Cis isomer are identified and integrated.

In one embodiment, the average double bond position can be measured using Gas Chromatography with a flame ionization method. Using a column with a stationary phase which is 50% phenyl and 50% methylpolysiloxane, allows for the separation of the alpha and beta isomers at each olefin double bond position along a linear hydrocarbon of at least C8 to C20. An example of the analysis of an isomerized olefin using the Gas Chromatography method disclosed is seen in FIG. 3. The peaks corresponding to each identified isomer can be integrated, and the area percent multiplied by the double bond position represented by the isomer. The products are summed and normalized to give an average double bond position for an isomerized olefin.

| C16 olefin isomers | Double bond position | area % | Double bond addition |
|---|---|---|---|
| Trans 8-Hexadecene | 8 | 11.9% | 0.95 |
| Cis 8-Hexadecene | 8 | 1.1% | 0.09 |
| Trans 7-Hexadecene | 7 | 1.8% | 0.13 |
| Cis 7-Hexadecene | 7 | 2.7% | 0.19 |
| Trans 5/6-Hexadecene | 5.5 | 7.2% | 0.39 |
| 1-Hexadecene | 1 | 0.0% | 0.00 |
| Cis 5/6-Hexadecene | 5.5 | 10.4% | 0.57 |
| Trans 4-Hexadecene | 4 | 12.6% | 0.50 |
| Cis 4-Hexadecene | 4 | 5.5% | 0.22 |
| Trans 3-Hexadecene | 3 | 16.7% | 0.50 |
| Cis 2-Hexadecene | 3 | 5.8% | 0.17 |
| Trans 2-Hexadecene | 2 | 16.4% | 0.33 |
| Cis 2-Hexadecene | 2 | 7.9% | 0.16 |
| Totals | | 100.0% | 4.21 |

Table (4) Shows isomer of Hexadecene in descending order of the left to right peaks seen in FIG. 3, Gas Chromatography trace of Isomerized C16 linear olefin.

Figure 4:
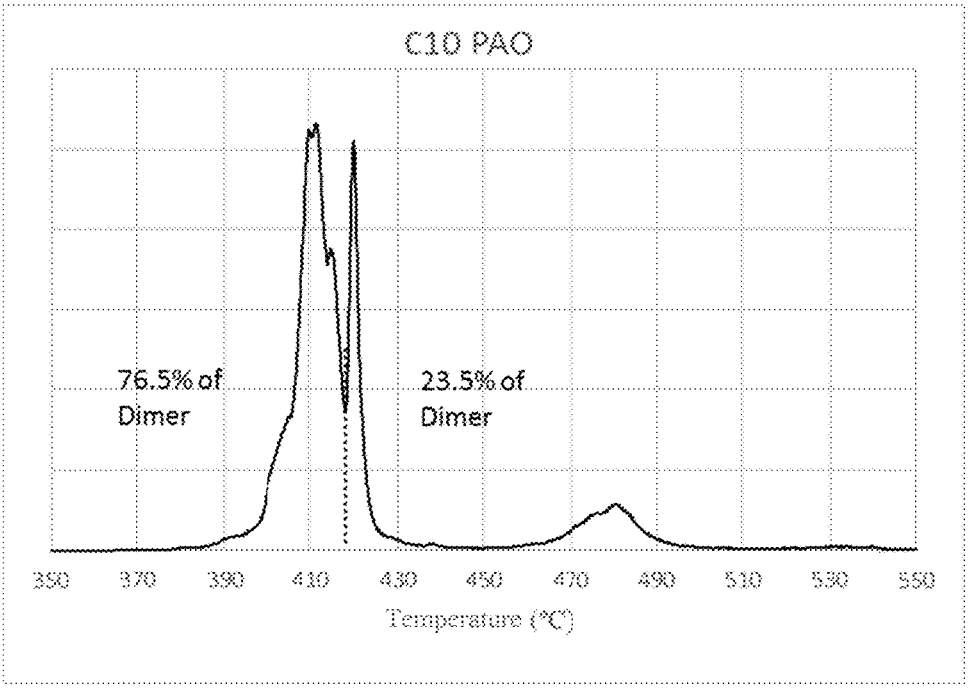
FIG. 4 shows a simulated distillation trace of a 1-Decene based PAO (trimer).

Furthermore, according to one aspect, the isomerization that can occur during oligomerization at high temperatures can create a large number of branched isomers, in addition to any branches introduced by the isomerization of olefin feed pre-oligomerization. Referring to FIG. 4, a simulated distillation gas chromatography (GC) method, performed according to ASTM D2887, shows the changes in the distribution of isomers. FIG. 4 shows a decene based PAO with a sharp singlet on the right of the main trimer peak. The same is seen in the C16 PAO, when oligomerized without isomerization during oligomerization, in FIG. 5. This peak characterizes isomers having a single branch, or the greatest linearity, as they elute last from the GC column and have the highest boiling point. In contrast, FIG. 6 shows the simulated distillation trace of a C16 polyolefin base oil that was isomerized prior to oligomerization, as well as exposed to isomerization during oligomerization. Isomerized oligomers with less than 10% by area of the singular branched isomers, show improved the low temperature viscometrics for oligomers of long chain olefins (C14-C18).

FIG. 5 shows the boiling point distribution of the dimer and the average boiling point of the isomers containing a single branch as characterized by ASTM D2887. The area under any portion of the boiling point curve can be integrated and compared to the total area bounded by the entire boiling point curve and the base line to obtain an area percent. The singularly branched isomers form a distinct boiling point distribution with a peak at the highest boiling range of the dimer. The area percent of the singularly branched isomers can be compared to the total area percent of dimer to obtain the fraction of singly branched isomers in the dimer. Area percent estimates for the overlapping boiling point distributions within the dimer range and can be calculated by the perpendicular drop method, where perpendicular lines are drawn from the valleys (minima) between two peaks to the base line and the area calculated by integrating the area bounded by the vertical lines, the GC signal curve, and the base line.

According to one aspect of the disclosure, the fraction of highest boiling point singularly branched dimers as compared to the total dimer is characterized to be less than 0.1% by area, preferably less than 0.05% by area, or even preferably less than 0.01% by area (not present or detectable) as shown in FIG. 6. This level of isomerization allows for improvement in the cold flow properties seen in tables 1, 2, and 3 discussed above.

Branching Index Requirements

By increasing the isomerization in the olefin monomers and/or oligomers, such as by changing the average double bond position in the olefin monomers to provide a defined average double bond position, and/or by controlling oligomerization conditions to increase isomerization (skeletal isomerization or otherwise), the resulting oligomer product may exhibit increased branching, as reflected in an increased branching index. As discussed above, the branching index is calculated by determining the number of methyl hydrogens in the product, divided by the total number of hydrogens (non-benzylic) measured by 1H NMR. Surprisingly, by using selective olefin isomerization pre-oligomerization, or optionally in combination with isomerization during oligomerization, and/or even post-oligomerization isomerization of the oligomer, the dimer fraction comprised of C28-C36 saturated hydrocarbons is found to have excellent physical properties for 0W engine oils, when branching index is maintained between 22 and 26 per 100 carbons (or 0.22 and 0.26).

The table 5 below shows the comparison of a conventional 4 cSt base oil made from 1-decene trimer, and example 4 according to the present disclosure, which is a C14 and C16 dimer. The table shows that the Branching index of Example 4 is greater than 22, and the physico-chemical properties of the hydrogenated product in example 4 are improved over the 1-decene trimer product, and has better Noack and VI properties, while the CCS is comparable.

TABLE (5)

Comparison of the Physico Chemical Properties for a commercial 4 cSt PAO and 4 cSt product of this invention, example 4.

| Characteristic | PAO | Example 4 |
|---|---|---|
| Composition | | |
| Dimer | 85 | 100 |
| Trimer | 15 | traces |
| Tetramer | — | — |
| Branching Index | 21.88 | 22.5 |
| Physico chemical Characteristics | | |
| Vis at 100 C. | 4.10 | 4.00 |
| Vis at 40 C. | 19.0 | 17.3 |
| VI | 126 | 132 |
| Pour point, C. | −66 | −33 |
| Noack, % wt. Loss | <14.0 | 12.5 |
| CCS at −35° C. | 1450 | 1469 |

Conversely prior PAOs made with C8-C12 olefins have been understood to have better properties when they have a branching ratio below 0.19 as described in U.S. Pat. Nos. 8,501,675 and 4,827,064. In the table below, the properties of PIO dimer made with C13 through C16 internal olefins, PAO trimer made with decene alpha olefins, and Example 4 of the present disclosure show that even though example 4 has a higher 1H NMR CH3/CH2 ratio (branching ratio) than the conventional PAO and PIO, it nonetheless has superior Noack and VI.

TABLE (6)

Comparison of the Physico Chemical Properties for 4 cSt PIO, PAO and 4 cSt product of this invention, example 4.

| Characteristic | PIO | PAO | Example 4 |
|---|---|---|---|
| Composition | | | |
| Dimer | 100 | 85 | 100 |
| Trimer | traces | 15 | traces |
| Tetramer | — | — | — |
| NMR CH3/CH2 ratio | 0.208 | 0.196 | >0.23 |
| Physico chemical Characteristics | | | |
| Vis at 100 C. | 4.33 | 3.84 | 4.00 |
| Vis at 40 C. | 20.35 | 16.7 | 17.3 |
| VI | 122 | 124 | 132 |
| Pour point, C | −51 | −64 | −33 |
| Noack, % wt. Loss | 15.3 | 15.2 | 12.5 |

PIO and PAO data taken from: Synthetic Lubricants And High-Performance Functional Fluids, Revised And Expanded. Edited by Leslie R. Rudnick and Ronald L. Shubkin; CRC Press 1999, Table 1, page 55.

The calculated Branching Index (BI) and paraffin Branching Proximity (BP) for a representative example of a 1-tetradecene and 1-hexadecene dimer 4 cSt PAO lubricant oil made according to aspects of the disclosure is shown in FIG. 9.

For purposes of comparison, the calculated Branching Index (BI) and paraffin Branch Proximity (BP) for a representative example of a 1-decene trimer 4 cSt PAO lubricant oil is shown in FIG. 11.

The calculated Branching Index (BI) and paraffin Branching Proximity (BP) for a representative example of a 4 cSt isomerized-GTL lubricant oil is shown in FIG. 12.

Low Temperature Viscosity

Another aspect of the disclosure is that the base oils also have excellent viscometric properties under low temperature and high shear, making them very useful in multigrade engine oils. The cold-cranking simulator apparent viscosity (CCS Viscosity) is a standard test used to measure the viscometric properties of lubricating base oils under low temperature and high shear. The test method to determine CCS Viscosity is ASTM D 5293-15. Results are reported in centipoise, cP. CCS Viscosity has been found to correlate with low temperature engine cranking. The CCS Viscosity measured at −35° C. of the lubricating base oils of this invention are relatively low. The combination of kinematic viscosity at 100° C. and CCS (dynamic viscosity) at −35° C. is represented by the following formula:

$$\text{CCS viscosity at } -35^\circ\text{ C.} < -1333.3(KV100)^2 + 11933(KV100) - 24900$$

This formula is represented in the plot of CCS Viscosity vs. Kinematic viscosity at 100° C. shown in FIG. 7. An exemplary characteristic of the invention is that the CCS Viscosity plotted against Kinematic viscosity at 100° C. will lay below the curve.

Noack Volatility

Noack volatility of engine oil, as measured by ASTM D5800-15, has been found to correlate with oil consumption in passenger car engines. Strict requirements for low volatility are important aspects of several recent engine oil specifications, such as, for example, ACEA A-3 and B-3 in Europe, and SAE J300-01, ILSAC GF-5, and future ILSAC GF-6, in North America. Any new lubricating base oil developed for use in 0W automotive engine oils should have a Noack volatility no greater than 14%. The Noack volatility of the lubricating base oils of this disclosure are relatively low. In preferred embodiments, the combination of kinematic viscosity at 100° C. and Noack volatility are represented by the following formula:

$$\text{Noack volatility} < -16.583(KV100)^2 + 125.36(KV100) + 223.8$$

This Noack formula is represented in the plot of Noack Volatility vs. Kinematic viscosity at 100° C. shown in FIG. 8. An exemplary characteristic of the disclosure is that the Noack volatility plotted against Kinematic Viscosity at 100° C. will lay below the curve.

EXAMPLES

The following Examples are provided to illustrate aspects of the disclosure, but are not intended in any way to limit the scope of the disclosure provided herein.

Example 1

Obtained 1-Hexadecene with less than 8% branched and internal olefins. Isomerized 1-hexadecene using a Pd on alumina catalyst in a batch slurry reaction at 200° C. for 4 hours to obtain linear internal olefin (LIO) with an average double bond position of 1.76. An olefin mixture comprised of 70% of said isomerized hexadecene and 30% of 1-tetradecene was oligomerized. The oligomerization reaction used between 1 and 10 PSI of BF3 with a co-catalyst composition of BuOH and BuAc. The reaction was held at 100° C. during semi continuous addition of olefins and co-catalyst. The unreacted monomer was then distilled off and the residue was hydrogenated to a Br index (ASTM D2710) of less than 1000 mg Br/100 g. A following distillation was used to remove the dimer from the residue to obtain a base oil with a KV100 of 4.21 cSt, with a viscosity index of 128, with a −33° C. pour point (ASTM D97), a dynamic viscosity at −35° C. of 1889 cP (ASTM D5923), and a Noack volatility (ASTM D5800) of 11.8%.

Example 2

Obtained 1-Hexadecene with less than 8% branched and internal olefins. Isomerized 1-hexadecene using a Pd on alumina catalyst in a batch slurry reaction at 260° C. for 4 hours to obtain linear internal olefin (LIO) with an average double bond position of 2.54. An olefin mixture comprised of 70% of said isomerized hexadecene and 30% of 1-tetradecene was oligomerized. The oligomerization reaction used between 1 and 10 psi of BF3 with a co-catalyst composition of BuOH and BuAc. The reaction was held at 100° C. during semi continuous addition of olefins and co-catalyst. The unreacted monomer was then distilled off and the residue was hydrogenated to a Br index (ASTM D2710) of less than 200 mg Br/100 g. A following distillation was used to remove the dimer from the residue to obtain a base oil with a KV100 of 4.24 cSt, with a viscosity index of 120, with a −45° C. pour point (ASTM D97), a dynamic viscosity at −35° C. of 2005.5 cP (ASTM D5923), and a Noack volatility (ASTM D5800) of 12.1%.

Example 3

Obtained 1-Hexadecene with less than 8% branched and internal olefins. Isomerized 1-hexadecene using a Pd on alumina catalyst in a batch slurry reaction at 260° C. for 4 hours to obtain linear internal olefin (LIO) with an average double bond position of 3.15. An olefin mixture comprised of 70% of said isomerized hexadecene and 30% of 1-tetradecene was oligomerized. The oligomerization reaction used between 1 and 10 psi of BF3 with a co-catalyst composition of BuOH and BuAc. The reaction was held at 100° C. during semi continuous addition of olefins and co-catalyst. The unreacted monomer was then distilled off and the residue was hydrogenated to a Br index (ASTM D2710) of less than 200 mg Br/100 g. A following distillation was used to remove the dimer from the residue to obtain a base oil with a KV100 of 4.24 cSt, with a viscosity index of 120, with a −45° C. pour point (ASTM D97), a dynamic viscosity at −35° C. of 2005.5 cP (ASTM D5923), and a Noack volatility (ASTM D5800) of 12.1%.

Example 4

Obtained 1-Hexadecene with less than 8% branched and internal olefins. Isomerized 1-hexadecene using a Pd on alumina catalyst in a batch slurry reaction at 270° C. for 4 hours to obtain linear internal olefin (LIO) with an average double bond position of 3.85. An olefin mixture comprised of 70% of said isomerized hexadecene and 30% of 1-tetradecene was oligomerized. The oligomerization reaction used in 6 psi of BF3 with a co-catalyst composition of BuOH and BuAc. The reaction was held at 100° C. during semi continuous addition of olefins and co-catalyst. The unreacted monomer was then distilled off and the residue was hydrogenated to a Br index (ASTM D2710) of less than 200 mg Br/100 g. A following distillation was used to remove the dimer from the residue to obtain a base oil with a KV100 of 3.85 cSt, with a viscosity index of 132, with a −33° C. pour point, a dynamic viscosity at −35° C. of 1469 (ASTM D5923), and a Noack volatility (ASTM D5800) of 12.5%.

Example 5

Obtained 1-hexadecene with less than 8% branched and internal olefins. Isomerized 1-hexadecene using a Pd on alumina catalyst in a batch slurry reaction at 270° C. for 4 hours to obtain linear internal olefin (LIO) with an average double bond position of 4.21. An olefin mixture comprised of 70% of said isomerized hexadecene and 30% of 1-tetradecene was oligomerized. The oligomerization reaction used between 1 and 10 psi of BF3 with a co-catalyst composition of BuOH and BuAc. The reaction was held at 100° C. during semi continuous addition of olefins and co-catalyst. The unreacted monomer was then distilled off and the residue was hydrogenated to a Br index (ASTM D2710) of less than 200 mg Br/100 g. A following distillation was used to remove the dimer from the residue to obtain a base oil with a KV100 of 4.21 cSt, with a viscosity index of 127, with a −33° C. pour point, a dynamic viscosity at −35° C. of 1642 (ASTM D5923), and a Noack volatility (ASTM D5800) of 11.6%.

Example 6

Obtained 1-hexadecene with less than 8% branched and internal olefins. Isomerized 1-hexadecene using a Pd on alumina catalyst in a batch slurry reaction at 270° C. for 4 hours to obtain linear internal olefin (LIO) with an average double bond position of 2.7. An olefin mixture comprised of 70% of said isomerized hexadecene and 30% of 1-tetradecene was oligomerized. The oligomerization reaction used between 1 and 10 psi of BF3 with a co-catalyst composition of BuOH and BuAc. The reaction was held at 100° C. during semi continuous addition of olefins and co-catalyst. The unreacted monomer was then distilled off and the residue was hydrogenated to a Br index (ASTM D2710) of less than 200 mg Br/100 g. A following distillation was used to remove the dimer from the residue to obtain a base oil with a KV100 of 4.04 cSt, with a viscosity index of 132, with a −36° C. pour point, a dynamic viscosity at −35° C. of 1593 (ASTM D5923), and a Noack volatility (ASTM D5800) of 12.2%.

Example 7

Obtained 1-hexadecene with less than 8% branched and internal olefins. Isomerized 1-hexadecene using a Pd on alumina catalyst in a batch slurry reaction at 260° C. for 4 hours to obtain linear internal olefin (LIO) with an average double bond position of 3.85. An olefin mixture comprised of 50% of said isomerized hexadecene and 50% of 1-tetradecene was oligomerized. The oligomerization reaction used between 1 and 10 psi of BF3 with a co-catalyst composition of BuOH and BuAc. The reaction was held at 100° C. during semi continuous addition of olefins and co-catalyst. The unreacted monomer was then distilled off and the residue was hydrogenated to a Br index (ASTM D2710) of less than 1000 mg Br/100 g. A following distillation was used to remove the dimer from the residue to obtain a base oil with a KV100 of 3.7 cSt, with a viscosity index of 136, with a −27° C. pour point (ASTM D97), a dynamic viscosity at −35° C. of 1030 cP (ASTM D5923), and a Noack volatility (ASTM D5800) of 12.3%.

Definitions

Average Double Bond Position:

The term "Average Double Bond Position" as used herein refers to the average of the double bond positions for all olefins in the feed and/or olefin mixture, where a double bond position of '1' is assigned for a double bond located between a terminal end carbon and the adjacent carbon (terminal end carbon+1), a double bond position of '2' is assigned for a double bond located between this adjacent carbon (terminal end carbon+1) and the next adjacent carbon (terminal end carbon+2), etc. In one embodiment, the Average Double Bond Position of an olefin can be determined by using a Gas Chromatographic Method. According to one aspect, a suitable Gas Chromatographic method uses a column with a stationary phase which is 50% phenyl and 50% methylpolysiloxane, to allow for the separation of the alpha and beta isomers at each double bond position along a hydrocarbon chain, such as a hydrocarbon chain having a chain length in the range of C8 to C20. The isomers with the double bond between the terminal end carbon and adjacent carbon are labeled as the alpha isomers. The cis and trans isomers of the internal olefins are separated for each of the given double bond positions by the isomer's polarity and boiling point (e.g. 2-hexadecene, 3-hexadecene, etc.). The peak area of the Gas Chromatograph corresponding to each isomer integrated, and the area percent multiplied by the double bond position of each the isomer. The products are summed and normalized to give an average double bond position for an isomerized olefin monomer feedstock.

Olefin

The term "Olefin" as used herein refers a hydrocarbon containing at least one carbon-carbon double bond. For example, according to aspects of the disclosure herein, an olefin may comprise a hydrocarbon chain length of from C14 to C18, and may have a double bond at an end (primary position) of the hydrocarbon chain (alpha-olefin) or at an internal position (internal-olefin). In one embodiment, the olefin is a mono-olefin, meaning that the olefin contains only a single double-bond group.

Alpha Olefins

The term "Alpha Olefin" as used herein refers an olefin that has α carbon-carbon double bond at an end of the olefin hydrocarbon chain (terminal position). For example, according to aspects of the disclosure herein, alpha olefins may comprise a hydrocarbon chain length of from C14 to C18, such as compounds having a chemical formula of C14H28, C16H32 and C18H36. In one embodiment, the alpha olefin is a mono-alpha-olefin, meaning that the alpha olefin contains only a single double-bond group.

Linear Alpha Olefin (LAO)

The term "Linear Alpha Olefin" as used herein refers an olefin that is linear (i.e., unbranched), and has a double bond at an end of the olefin hydrocarbon chain (terminal position). For example, according to aspects of the disclosure herein, alpha olefins may comprise a hydrocarbon chain length of from C14 to C18, such as compounds having a chemical formula of C14H28, C16H32 and C18H36. In one embodiment, the linear alpha olefin is a mono-alpha-olefin, meaning that the alpha olefin contains only a single double-bond group.

Internal Olefins

The term "Internal Olefin" as used herein refers an olefin that has an internal carbon-carbon double bond that is interior to the terminal end of the olefin hydrocarbon chain (e.g., at a position other than the alpha-position), and does not contain α carbon-carbon double bond at the terminal position. For example, according to aspects of the disclosure herein, internal olefins may comprise a hydrocarbon chain length of from C14 to C18, such as compounds having a chemical formula of the olefin has no more carbons than the specified carbon number, e.g. C14H28, C16H32 and C18H36. In one embodiment, the internal olefin is a mono-internal-olefin, meaning that the internal olefin contains only a single double-bond group.

Linear Internal Olefins

The term "Linear Internal Olefin" as used herein refers an olefin that is linear (i.e., unbranched), and that has α carbon-carbon double bond that is interior to the terminal end of the olefin hydrocarbon chain (e.g., at a position other than the alpha-position), and does not contain α carbon-carbon double bond at the terminal position. For example, according to aspects of the disclosure herein, linear internal olefins may comprise a hydrocarbon chain length of from C14 to C18, such as compounds having a chemical formula of the olefin has no more carbons than the specified carbon number, e.g. C14H28, C16H32 and C18H36. In one embodiment, the linear internal olefin is a mono-internal-olefin, meaning that the linear internal olefin contains only a single double-bond group.

Linear Mono-Olefins

Mixture of olefins or alkenes distinguished from other olefins with a similar molecular formula by linearity of the hydrocarbon chain length and a distribution of double bond positions in the molecule, from alpha to internal position. For example, according to aspects of the disclosure herein, linear mono-olefins may comprise a hydrocarbon chain length of from C14 to C18 with a chemical formula C14H28, C16H32, and/or C18H36.

Isomerized Olefin

The term "Isomerized Olefin" is used herein to refer to an olefin feed and/or mixture that has been subjected to an isomerization process, such that an average double-bond position in the olefin and/or olefins feed has been shifted from a position close to or at the terminal double position (alpha position), to a distribution of cis/trans double bond positions more interior along the chain length. For example, in one embodiment, isomerized olefins can be formed by isomerization of linear alpha olefins (LAO), which have their double bond at the terminal end of the hydrocarbon chain, to linear internal olefins having an average double bond position more interior along the chain.

Branched Alpha-Olefins

The term "Branched Alpha-Olefin" is used herein to refer to an olefin that has alkyl (such as methyl or ethyl) branch groups along the hydrocarbon chain length of the olefin, and has a double bond at an end of the olefin hydrocarbon chain (primary position). For example, according to aspects of the disclosure herein, branched alpha olefins may comprise C14 to C18 olefins. In one embodiment, the branched alpha olefin is a mono-alpha-olefin, meaning that the branched alpha olefin contains only a single double-bond group.

Branched Internal Olefins

The term "Branched Internal-Olefin" is used herein to refer to an olefin that has alkyl (such as methyl or ethyl, or even longer) branch groups along the hydrocarbon chain length of the olefin, and has a double bond that is interior to the terminal end of the olefin hydrocarbon chain (e.g., at a position other than the alpha-position), and does not contain α carbon-carbon double bond at the terminal position. For example, according to aspects of the disclosure herein, branched internal olefins may comprise C14 to C18 olefins. In one embodiment, the branched internal olefin is a mono-alpha-olefin, meaning that the branched alpha olefin contains only a single double-bond group.

Dimer

The term "Dimer" as used herein refers to molecules formed by the combination of two monomers via a chemical process, where in monomers may be the same or different type of monomer unit. The dimer may be formed by chemical reaction and/or other type of bonding between the monomers. In one embodiment, a dimer is the product of oligomerization between two olefin monomers.

Oligomer

The term "oligomer" as used herein refers to a molecule having 2-100 monomeric units, and encompasses dimers, trimers, tetramers, pentamers, and hexamers. An oligomer may comprise one type of monomer unit or more than one type of monomer unit, for example, two types of monomer units, or three types of monomer units. "Oligomerization" as used herein refers to the formation of a molecule having 2-100 monomeric units from one or more monomers, and encompasses dimerization, trimerization, etc. of one type or different types of monomer, and also encompasses the formation of adducts and/or complexes between the same or more than one type of monomer.

Dimer Total Average Carbon Number

The term "Dimer Total Average Carbon Number" is used herein to refer to a total number of carbons in the dimer. Accordingly, a "C29-C36" dimer as referred to herein is a dimer having a total average number of carbon atoms in a range of from 29 to 36.

Terpenes

The term "Terpenes" as used herein refers to compounds having multiples of units of isoprene, which has the molecular formula $C_5H_8$. The basic molecular formula of terpenes are multiples of that, $(C_5H_8)_n$ where n is the number of linked isoprene units, and terpenes can be derived biosynthetically from such units of isoprene. Monoterpenes consist of two isoprene units and have the molecular formula $C_{10}H_{16}$. Sesquiterpenes consist of three isoprene units.

Renewable

The term "Renewable" as used herein means any biologically derived composition, including fatty alcohols, olefins, or oligomers. Such compositions may be made, for nonlimiting example, from biological organisms designed to manufacture specific oils, as discussed in WO 2012/141784, but do not include petroleum distilled or processed oils such as, for non-limiting example, mineral oils. A suitable method to assess materials derived from renewable resources is through "Standard Test Methods for Determining the Biobased Content of Solid, Liquid, and Gaseous Samples Using Radiocarbon Analysis" (ASTM D6866-12 or ASTM D6866-11). Counts from $^{14}C$ in a sample can be compared directly or through secondary standards to SRM 4990C. A measurement of 0% $^{14}C$ relative to the appropriate standard indicates carbon originating entirely from fossils (e.g., petroleum based). A measurement of 100% $^{14}C$ indicates carbon originating entirely from modern sources (See, e.g., WO 2012/141784, incorporated herein by reference).

Base Oil

The term "Base Oil" as used herein refers an oil used to manufacture products including dielectric fluids, hydraulic fluids, compressor fluids, engine oils, lubricating greases, and metal processing fluids.

Viscosity Index

The term "Viscosity index" as used herein refers to viscosity index as measured according to "Standard Practice for Calculating Viscosity Index From Kinematic Viscosity at 40 and 100° C." (ASTM D2270) published by ASTM International, which is incorporated herein by reference in its entirety.

Kinematic Viscosity

The term "Kinematic Viscosity" as used herein refers to viscosities at 40° C. and at 100° C. measured according to "Standard Test Method for Kinematic Viscosity of Transparent and Opaque Liquids (and Calculation of Dynamic Viscosity)" (ASTM D445) published by ASTM International, which is incorporated herein by reference in its entirety.

Cold-Cranking Simulator Viscosity

The term "Cold-Cranking Simulator Viscosity" (abbreviated CCS) refers to cold cranking simulator viscosity as measured according to "Standard Test Method for Apparent Viscosity of Engine Oils Between −5 and −35° C. Using the Cold-Cranking Simulator" (ASTM D5293) published by ASTM International, which is incorporated herein by reference in its entirety.

Pour Point

The term "Pour Point" refers to temperature at which a lubricant becomes semi solid and at least partially loses its flow characteristics, and is measured according to "Standard Test Method for Pour Point of Petroleum Products" (ASTM D97) published by ASTM International, which is incorporated herein by reference in its entirety.

Noack Volatility

The term "Noack Volatility" is used herein to a measure of evaporative weight loss as_carried out according to "Standard Test Method for Evaporation Loss of Lubricating Oils by the Noack Method" (ASTM D5800), or "Standard Test Method for Evaporation Loss of Lubricating Oils by Thermogravimetric Analyzer (TGA) Noack Method" (ASTM D6375, TGA-Noack method), each published by ASTM International, and each of which is incorporated herein by reference in its entirety.

Bromine Index

The term "Bromine Index" is used herein to refer to a test for determining the degree of unsaturation of a product, such as a hydrogenated oligomer and/or dimer product, and can be determined in accordance with ASTM D2710-09, which is incorporated by reference herein in its entirety.

Branching Ratio (BR)

The "Branching Ratio" as used herein refers to a measure of the number of methyl groups ($CH_3$) to the number of methylene groups ($CH_2$) in a sample by 1H NMR, such as sample comprising dimer or other oligomer. The Branching Ratio can be defined according to the following formula:

$$\text{Branching Ratio (BR)} = (\text{methyl groups})/(\text{methylene groups}).$$

The number of methyl and methylene groups can be determined via Infrared Spectroscopy or other accepted method. Methods for determining the Branching Ratio are further described in U.S. Pat. Nos. 4,827,064; 5,264,642; 8,501,675, which are hereby incorporated by reference herein in their entireties.

Branching Index (BI)

The term "Branching Index" is referred to herein as a measure of the percentage of methyl protons divided by the total number of protons (non-benzylic) in a sample, such as a sample comprising a dimer or oligomer. According to one embodiment, the Branching Index can be calculated using 1H NMR, by determining the percent of the non-benzylic methyl hydrogen content in the range of 0.5 to 1.05 ppm, per the total non-benzylic aliphatic hydrogen content in the range of 0.5 to 2.1 ppm. The formula for calculating the Branching Index is as follows:

branching index (BI)=(total content of methyl group hydrogens/total content of hydrogens)*100.

Measurement of the Branching Index is further described in U.S. Pat. Nos. 6,090,989 and 7,018,525, both of which are hereby incorporated by reference herein in their entirety.

Branch Proximity (BP)

The term "Branching Proximity" is used herein is used to refer to the % equivalent recurring methylene carbons, which are four or more removed from a carbon end group or branching carbon group (e.g., the epsilon carbons as shown in FIG. 13). In one embodiment, the Branching Proximity can be evaluated using 13C NMR, by measuring a peak corresponding to the recurring methylene carbons (e.g., at about 29.8 ppm), and determining the content as a percent of all carbon atoms measured in the 13C NMR spectrum. According to one aspect, the Branching Proximity may be determined according to the following formula:

paraffin branching proximity (BP)=(number of εcarbon groups/total number of carbon groups)*100, where an ε carbon group is defined as a carbon group that is separated from any terminal carbon atom groups or branching carbon groups by at least 4 carbon groups. Further description of the measurement of the Branching Proximity is described in U.S. Pat. No. 6,090,989, and further description of epsilon carbons is provided in U.S. 2008/0171675, both of which are hereby incorporated by reference herein in their entireties.

Aspects of the invention may further be described with respect to the following embodiments:

Embodiment 1

A saturated hydrocarbon base oil comprising:

dimers of C14-C18 olefin monomers, the dimers having an average carbon number in a range of from 29 to 36, the dimers being present in an amount of at least 95 wt % of the saturated hydrocarbon base oil, wherein the saturated hydrocarbon base oil is characterized in that:

an average branching index (BI) of the oil as determined by 1H NMR is in a range of from 22 to 26, wherein the branching index (BI) is equivalent to the following equation (1):

branching index (BI)=(number of methyl group hydrogens/total number of hydrogens)*100, and (1)

an average paraffin branching proximity (BP) as determined by 13C NMR in a range of from 18 to 26, wherein the paraffin branching proximity (BP) is equivalent to the following equation (2):

paraffin branching proximity (BP)=(number of ε carbon groups/total number of carbon groups)*100, (2)

where an ε carbon group is defined as α carbon group that is separated from any terminal carbon atom groups or branching carbon groups by at least 4 carbon groups, wherein the saturated hydrocarbon base oil comprises a Noack Volatility that is less than 14%, a Pour Point no greater than −27° C., and a CCS at −35° C. of less than 1800 cP.

Embodiment 2

The saturated hydrocarbon base oil prepared according to embodiment 1 wherein the saturated hydrocarbon base oil has a branching proximity (BP) as determine by 13C NMR in a range from 20 to 24.

Embodiment 3

The saturated hydrocarbon base oil according to any preceding embodiment, wherein the saturated hydrocarbon base oil comprises a KV(100) that is in the range of 3.7 to 4.8, a viscosity index that is greater than 125.

Embodiment 4

The saturated hydrocarbon base oil according to any preceding embodiment, wherein the saturated hydrocarbon base oil comprises a KV(100) that is in the range of 3.7 to 4.5, a viscosity index that is greater than 125.

Embodiment 5

The saturated hydrocarbon base oil according to any preceding embodiment, wherein the saturated hydrocarbon base oil has a viscosity index that is greater than 130.

Embodiment 6

The saturated hydrocarbon base oil according to any preceding embodiment, wherein the saturated hydrocarbon base oil has a viscosity index that is greater than 135.

Embodiment 7

The saturated hydrocarbon base oil according to any preceding embodiment, wherein the saturated hydrocarbon base oil has a viscosity index that less than 140.

Embodiment 8

The saturated hydrocarbon base oil according to any preceding embodiment, wherein the saturated hydrocarbon base oil comprises a Cold Crank Simulated (CSS) dynamic viscosity at −35° C. of 1800 cP or less.

Embodiment 9

The saturated hydrocarbon base oil according any preceding embodiment, wherein the saturated hydrocarbon base oil comprises a Cold Crank Simulated (CSS) dynamic viscosity at −35° C. of 1700 cP or less.

Embodiment 10

The saturated hydrocarbon base oil according to any preceding embodiment, wherein the saturated hydrocarbon base oil comprises a Cold Crank Simulated (CSS) dynamic viscosity at −35° C. of 1600 cP or less.

Embodiment 11

The saturated hydrocarbon base oil according to any preceding embodiment, wherein the saturated hydrocarbon base oil comprises a Cold Crank Simulated (CSS) dynamic viscosity at −35° C. of 1500 cP or less.

Embodiment 12

The saturated hydrocarbon base oil according to any preceding embodiment, wherein the saturated hydrocarbon base oil comprises a Cold Crank Simulated (CSS) dynamic viscosity at −35° C. of 1400 cP or less.

Embodiment 13

The saturated hydrocarbon base oil according to any preceding embodiment, wherein the saturated hydrocarbon base oil comprises a Cold Crank Simulated (CSS) dynamic viscosity at −35° C. of 1300 cP or less.

Embodiment 14

The saturated hydrocarbon base oil according to any preceding embodiment, wherein the saturated hydrocarbon base oil comprises a Cold Crank Simulated (CSS) dynamic viscosity at −35° C. of 1200 cP or less.

Embodiment 15

The saturated hydrocarbon base oil according to any preceding embodiment, wherein the saturated hydrocarbon base oil comprises a Cold Crank Simulated (CSS) dynamic viscosity at −35° C. which is less than the value of the following equation:

$$\text{Dynamic viscosity by CCS at } -35^\circ\text{ C.} \leq -14.167(KV100)^2+107.42(KV100)-190.$$

Embodiment 16

The saturated hydrocarbon base oil according to any preceding embodiment, wherein the saturated hydrocarbon base oil comprises a Noack Volatility which is less than 14% loss by ASTM D5800.

Embodiment 17

The saturated hydrocarbon base oil according to any preceding embodiment, wherein the saturated hydrocarbon base oil comprises a Noack Volatility which is less than 13% loss by ASTM D5800.

Embodiment 18

The saturated hydrocarbon base oil according to any preceding embodiment, wherein the saturated hydrocarbon base oil comprises a Noack Volatility which is less than 12% loss by ASTM D5800.

Embodiment 19

The saturated hydrocarbon base oil according to any preceding embodiment, wherein the saturated hydrocarbon base oil comprises a Noack Volatility which is less than 11% loss by ASTM D5800.

Embodiment 20

The saturated hydrocarbon base oil according to any preceding embodiment, wherein the saturated hydrocarbon base oil comprises a Noack Volatility which is less than 10% loss by ASTM D5800.

Embodiment 21

The saturated hydrocarbon base oil according to any preceding embodiment, wherein the saturated hydrocarbon base oil comprises a Noack Volatility which is less than 9% loss by ASTM D5800.

Embodiment 22

The saturated hydrocarbon base oil according to any preceding embodiment, wherein the saturated hydrocarbon base oil comprises a Noack Volatility which is less than 8% loss by ASTM D5800.

Embodiment 23

The saturated hydrocarbon base oil according to any preceding embodiment, wherein the saturated hydrocarbon base oil comprises a Noack Volatility which is less than 7% loss by ASTM D5800.

Embodiment 24

The saturated hydrocarbon base oil according to any preceding embodiment, wherein the saturated hydrocarbon base oil comprises a Noack Volatility by ASTM D5800 which is less than the value of the following equation:

$$\text{Noack Volatility} \leq -1583.3(KV100)^2+13858(KV100)-28500.$$

Embodiment 25

A saturated hydrocarbon base oil with less than 10% of the dimers containing singularly branched isomers according to simulated distillation (ASTM D2887).

Embodiment 26

A saturated hydrocarbon base oil with less than 5% of the dimers containing singularly branched isomers according to simulated distillation (ASTM D2887).

Embodiment 27

A saturated hydrocarbon base oil with less than 1% of the dimers containing singularly branched isomers according to simulated distillation (ASTM D2887).

Embodiment 28

A method of preparing a saturated hydrocarbon base oil, comprising:

isomerizing at least a portion of C14 to C18 alpha olefin monomers in a first feedstock to C14 to C18 internal olefins, under isomerization conditions sufficient to generate an isomerized C14 to C18 olefin monomer product having an average double bond position in the range of 1.5 to 5.0;

oligomerizing the isomerized C14 to C18 olefin monomer product in the presence of a catalyst, optionally in combination with a second feedstock comprising at least one of C14 to C18 alpha olefin monomers or C14 to C18 internal olefin monomers, to produce an oligomer product comprising dimers, trimers, and higher oligomers;

optionally, separating unreacted monomer from the oligomer product;

hydrogenating the oligomer product to form a saturated oligomer product comprising a mixture of branched saturated hydrocarbons including hydrogenated dimer, trimer and higher oligomers, the mixture of branched saturated hydrocarbons having a Bromine Index below 1000 mg Br2/100 g, as determined in accordance with ASTM D2710-09; and separating the hydrogenated dimer from the saturated oligomer product, wherein the base oil comprises the hydrogenated dimer separated from the saturated oligomer product.

Embodiment 29

The method of embodiment 28, wherein the first feedstock comprises C14 to C18 alpha olefin monomers selected from the group consisting of tetradecene, pentadecene, hexadecane, heptadecene and octadecene.

Embodiment 30

The method of any preceding embodiment, further comprising preparing the C14 to C18 alpha olefin monomers of the first feed stock by dehydration of C14 to C18 primary alcohols selected from the group consisting of tetradecanol, pentadecanol, hexadecanol, heptadecanol and octadecanol.

Embodiment 31

The method of any preceding embodiment, wherein C14 to C18 primary alcohols are converted to the C14 to C18 alpha olefin monomers of the first feedstock and isomerized to form the isomerized C14 to C18 olefin monomer product by exposure to a di-functional catalyst.

Embodiment 32

The method of any preceding embodiment, wherein the first feedstock comprises less than 20% by weight of branched olefin monomers.

Embodiment 33

The method of any preceding embodiment, wherein the first feedstock comprises less than 5% by weight of branched olefin monomers.

Embodiment 34

The method of any preceding embodiment, wherein an amount of decene in any of the first and/or second feedstocks is less than 10% by weight.

Embodiment 35

The method of any preceding embodiment, wherein an amount of decene in any of the first and/or second feedstocks is less than 5% by weight.

Embodiment 36

The method of any preceding embodiment, wherein the isomerization conditions comprise heating the C14 to C18 alpha olefin monomers in the presence of an isomerization catalyst to a temperature in a range of from 100 to 400° C.

Embodiment 37

The method of any of preceding embodiment, wherein the isomerization conditions comprise heating the C14 to C18 alpha olefin monomers in the presence of an isomerization catalyst in a fixed bed reactor with a liquid hourly space velocity (LHSV) of 0.5-2 h-1.

Embodiment 38

The method of any preceding embodiment, wherein isomerization of at least a portion of the C14 to C18 alpha olefin monomers comprises heating the monomers in the presence of an isomerization catalyst selected from the group consisting of activated alumina, gamma-alumina, zirconium oxide on gamma alumina, theta-alumina with or without the presence of alkali metal.

Embodiment 39

The method of any preceding embodiment, wherein the isomerization conditions result in greater than 50% conversion of the C14 to C18 olefin alpha olefin monomers to C14-C18 internal olefin monomers.

Embodiment 40

The method of any preceding embodiment, wherein the isomerization conditions result in greater than 60% conversion of the C14 to C18 olefin alpha olefin monomers to C14-C18 internal olefin monomers.

Embodiment 41

The method of any preceding embodiment, wherein the isomerization conditions result in greater than 70% conversion of the C14 to C18 olefin alpha olefin monomers to C14-C18 internal olefin monomers.

Embodiment 42

The method of any preceding embodiment, wherein the isomerization conditions result in greater than 80% conversion of the C14 to C18 olefin alpha olefin monomers to C14-C18 internal olefin monomers.

Embodiment 43

The method of any preceding embodiment, wherein the isomerization conditions result in greater than 90% conversion of the C14 to C18 olefin alpha olefin monomers to C14-C18 internal olefin monomers.

Embodiment 44

The method of any preceding embodiment, wherein the internal olefin monomer C14 to C18 is oligomerized with a second feedstock, the second feedstock comprising C14 to C18 internal olefin monomers.

Embodiment 45

The method of any preceding embodiment, wherein the internal olefin monomer C14 to C18 product is oligomerized with a second feedstock, the second feedstock comprising C14 to C18 alpha olefin monomers including one or more of linear and branched alpha olefins.

Embodiment 46

The method of any preceding embodiment, wherein the internal olefin monomer C14 to C18 product is oligomerized with a second feedstock comprising C14 to C18 alpha olefins including branched olefins in a content by weight of up to 36% by weight of the C14 to C18 alpha olefins.

Embodiment 47

The method of any preceding embodiment, wherein the internal olefin monomer C14 to C18 product is oligomerized with a second feedstock comprising C14 to C18 alpha olefins including branched olefins in a content by weight of up to 25% by weight of the C14 to C18 alpha olefins.

Embodiment 48

The method of any preceding embodiment, wherein the internal olefin monomer C14 to C18 product is oligomerized with a second feedstock comprising C14 to C18 alpha olefins including branched olefins in a content by weight of up to 15% by weight of the C14 to C18 alpha olefins.

Embodiment 49

The method of any preceding embodiment, wherein the internal olefin monomer C14 to C18 product is oligomerized with a second feedstock comprising C14 to C18 alpha olefins including branched olefins in a content by weight of up to 5% by weight of the C14 to C18 alpha olefins.

Embodiment 50

The method of any preceding embodiment, comprising oligomerizing the internal monomer olefin C14 to C18-product with a second feedstock comprising C14 to C18 alpha olefin monomers in a ratio by weight of the internal monomer olefin C14 to C18 product to the C14 to C18 alpha olefin monomers in a range of from 80:20 to 20:80.

Embodiment 51

The method of any preceding embodiment, comprising oligomerizing the internal monomer olefin C14 to C18 product with a second feedstock comprising C14 to C18 alpha olefin monomers in a ratio by weight of the internal monomer C14 to C18 product to the C14 to C18 alpha olefin monomers in a range of from 70:30 to 50:50.

Embodiment 52

The method of any preceding embodiment, wherein the internal monomer olefin C14 to C18 product is oligomerized with a second feedstock comprising C14 to C18 olefin monomers having a different chain length than the internal monomer olefin C14 to C18 olefin monomer product.

Embodiment 53

The method of any preceding embodiment, wherein the internal monomer olefin C14 to C18 monomer product comprises C16 to C18 internal olefin monomers, and is oligomerized with a second feedstock comprising C14 alpha olefin monomers.

Embodiment 54

The method of any preceding embodiment, wherein the internal monomer olefin C14 to C18 product comprises C16 internal olefin monomers, and is oligomerized with a second feedstock comprising C14 alpha olefins to form the oligomer product.

Embodiment 55

The method of any preceding embodiment, wherein the internal monomer olefin C14 to C18 product comprises C16 internal olefin monomers, and wherein the C16 internal olefin monomers are oligomerized with each other or a second feedstock comprising C16 olefin monomers to form the oligomer product.

Embodiment 56

The method of any preceding embodiment, wherein oligomerization is performed using a boron trifluoride oligomerization catalyst, an alcohol promoter, and an ester promoter in at least one continuously stirred reactor under oligomerization conditions;

Embodiment 57

The method of any preceding embodiment, wherein the oligomerization reaction is performed at a temperature in the range of from 15° C. to 110° C.

Embodiment 58

The method of any preceding embodiment, wherein the oligomerization reaction is performed at a temperature in the range of from 40° C. to 110° C.

Embodiment 59

The method of any preceding embodiment, wherein the oligomerization reaction is performed at a temperature in the range of from 60° C. to 110° C.

Embodiment 60

The method of any preceding embodiment, wherein the oligomerization reaction is performed at a temperature in the range of from 80° C. to 110° C.

Embodiment 61

The method of any preceding embodiment, wherein the oligomerization reaction is performed at a temperature in the range of from 90° C. to 110° C.

Embodiment 62

The method of any preceding embodiment, wherein the oligomerization is performed using a continuously stirred tank reactor.

Embodiment 63

The method of any preceding embodiment, wherein the average residence time of oligomers in a continuously stirred tank reactor is in the range from 60 to 400 minutes.

Embodiment 64

The method of any preceding embodiment, wherein the average residence time of oligomers in a continuously stirred tank reactor is in the range from 90 to 300 minutes.

Embodiment 65

The method of any preceding embodiment, wherein the average residence time of oligomers in a continuously stirred tank reactor is in the range from 120 to 240 minutes.

Embodiment 66

The method of any preceding embodiment, wherein the average residence time of oligomers in a continuously stirred tank reactor is in the range from 150 to 240 minutes.

Embodiment 67

The method of any of preceding embodiment, wherein the average residence time of oligomers in a continuously stirred tank reactor is in the range from 180 to 240 minutes.

Embodiment 68

The method of any preceding embodiment, wherein at least one of the first or second feedstocks comprises at least 50 wt % of a terpene.

Embodiment 69

The method of any preceding embodiment, wherein at least one of the first or second feedstocks comprises at least 40 wt % of a terpene.

Embodiment 70

The method of any preceding embodiment, wherein at least one of the first or second feedstocks comprises at least 30 wt % of a terpene.

Embodiment 71

The method of any preceding embodiment, wherein at least one of the first or second feedstocks comprises at least 20 wt % of a terpene.

Embodiment 72

The method of any preceding embodiment, wherein at least one of the first or second feedstocks comprises at least 10 wt % of a terpene.

Embodiment 73

The method of any preceding embodiment, wherein at least one of the first or second feedstocks comprises at least 5 wt % of a terpene.

Embodiment 74

The method of any preceding embodiment, wherein at least one of the first or second feedstocks comprises at least 1 wt % of a terpene.

Embodiment 75

The method of any preceding embodiment, wherein unreacted monomer is separated from the oligomer product and recycled for oligomerization thereof.

Embodiment 76

The method of any preceding embodiment, wherein the hydrogenated dimer is separated from the saturated oligomer product by a distillation process.

Embodiment 77

The method of any preceding embodiment, wherein the average double bond position of linear olefins in the isomerized C14 to C18 olefin monomer product is in the range of from 1.5 to 5.0.

Embodiment 78

The method of any preceding embodiment, wherein the average double bond position of linear olefins in the isomerized C14 to C18 olefin monomer product is in the range of from 1.5 to 4.5.

Embodiment 79

The method of any preceding embodiment, wherein the average double bond position of linear olefins the isomerized C14 to C18 olefin monomer product is in the range of from 2.0 to 4.4.

Embodiment 80

The method of any preceding embodiment, wherein the average double bond position of linear olefins the isomerized C14 to C18 olefin monomer product is in the range of from 2.5 to 4.2.

Embodiment 81

The method of any preceding embodiment, wherein the average double bond position of linear olefins the isomerized C14 to C18 olefin monomer product is in the range of from 3.0 to 4.0.

Embodiment 82

The method of any preceding embodiment, wherein the average double bond position of linear olefins the isomerized C14 to C18 olefin monomer product is in the range of from 3.5 to 3.9.

Embodiment 83

The method of any preceding embodiment, wherein oligomerization is performed under conditions to further at least partially isomerize the olefin monomers.

Embodiment 84

The method of any of preceding embodiment, wherein oligomerization product contains less than 0.5% benzylic groups.

What is claimed is:

1. A saturated hydrocarbon base oil comprising:

dimers of C14-C18 olefin monomers prepared by oligomerization of the C14-C18 olefin monomers in the presence of a $BF_3$ catalyst that causes isomerization of the C14-C18 olefin monomers during oligomerization, the dimers having an average carbon number in a range of from 29 to 36, the dimers being present in an amount of at least 95 wt % of the saturated hydrocarbon base oil, wherein the saturated hydrocarbon base oil is characterized in that:

an average branching index (BI) of the oil as determined by 1H NMR is in a range of from 22 to 26, wherein the branching index (BI) is equivalent to the following equation (1):

branching index (BI)=(number of methyl group hydrogens/total number of hydrogens)*100, and (1)

an average paraffin branching proximity (BP) as determined by 13C NMR in a range of from 18 to 26, wherein the paraffin branching proximity (BP) is equivalent to the following equation (2):

paraffin branching proximity (BP)=(number of c carbon groups/total number of carbon groups)*100, (2)

where an ε carbon group is defined as a carbon group that is separated from any terminal carbon atom groups or branching carbon groups by at least 4 carbon groups, wherein the saturated hydrocarbon base oil comprises a Noack Volatility that is less than 14%, a Pour Point no greater than −27° C., and a Cold Crank Simulated (CCS) dynamic viscosity at −35° C. of 1800 cP or less.

2. The saturated hydrocarbon base oil according to claim 1, wherein the saturated hydrocarbon base oil has a branching proximity (BP) as determined by 13C NMR in a range from 20 to 24.

3. The saturated hydrocarbon base oil according claim 1, wherein the saturated hydrocarbon base oil comprises a Cold Crank Simulated (CSS) dynamic viscosity at −35° C. of less than 1800 cP.

4. The saturated hydrocarbon base oil according to claim 1, wherein the saturated hydrocarbon base oil comprises a Cold Crank Simulated (CSS) dynamic viscosity at −35° C. which is less than the value of the following equation:

Dynamic viscosity by CCS at −35° C.≤−14.167 (KV100)^2+107.42(KV100) −190.

5. The saturated hydrocarbon base oil according to claim 1, wherein the saturated hydrocarbon base oil comprises a KV(100) that is in the range of 3.7 to 4.8, and a viscosity index that is greater than 125.

6. The saturated hydrocarbon base oil according to claim 1, wherein the saturated hydrocarbon base oil comprises a KV(100) that is in the range of 3.7 to 4.5, and a viscosity index that is greater than 125.

7. The saturated hydrocarbon base oil according to claim 1, wherein the saturated hydrocarbon base oil has a viscosity index that is greater than 130.

8. The saturated hydrocarbon base oil according to claim 1, wherein the saturated hydrocarbon base oil has a viscosity index that is greater than 135.

9. The saturated hydrocarbon base oil according to claim 1, wherein the saturated hydrocarbon base oil has a viscosity index that less than 140.

10. The saturated hydrocarbon base oil according claim 1, wherein the saturated hydrocarbon base oil comprises a Cold Crank Simulated (CSS) dynamic viscosity at −35° C. of 1700 cP or less.

11. The saturated hydrocarbon base oil according claim 1, wherein the saturated hydrocarbon base oil comprises a Cold Crank Simulated (CSS) dynamic viscosity at −35° C. of 1600 cP or less.

12. The saturated hydrocarbon base oil according claim 1, wherein the saturated hydrocarbon base oil comprises a Cold Crank Simulated (CSS) dynamic viscosity at −35° C. of 1500 cP or less.

13. The saturated hydrocarbon base oil according claim 1, wherein the saturated hydrocarbon base oil comprises a Cold Crank Simulated (CSS) dynamic viscosity at −35° C. of 1400 cP or less.

14. The saturated hydrocarbon base oil according claim 1, wherein the saturated hydrocarbon base oil comprises a Cold Crank Simulated (CSS) dynamic viscosity at −35° C. of 1300 cP or less.

15. The saturated hydrocarbon base oil according claim 1, wherein the saturated hydrocarbon base oil comprises a Cold Crank Simulated (CSS) dynamic viscosity at −35° C. of 1200 cP or less.

16. The saturated hydrocarbon base oil according to claim 1, wherein the saturated hydrocarbon base oil comprises a Noack Volatility which is less than 14% loss by ASTM D5800.

17. The saturated hydrocarbon base oil according to claim 1, wherein the saturated hydrocarbon base oil comprises a Noack Volatility which is less than 13% loss by ASTM D5800.

18. The saturated hydrocarbon base oil according to claim 1, wherein the saturated hydrocarbon base oil comprises a Noack Volatility which is less than 12% loss by ASTM D5800.

19. The saturated hydrocarbon base oil according to claim 1, wherein the saturated hydrocarbon base oil comprises a Noack Volatility which is less than 11% loss by ASTM D5800.

20. The saturated hydrocarbon base oil according to claim 1, wherein the saturated hydrocarbon base oil comprises a Noack Volatility which is less than 10% loss by ASTM D5800.

21. The saturated hydrocarbon base oil according to claim 1, wherein the saturated hydrocarbon base oil comprises a Noack Volatility which is less than 9% loss by ASTM D5800.

22. The saturated hydrocarbon base oil according to claim 1, wherein the saturated hydrocarbon base oil comprises a Noack Volatility which is less than 8% loss by ASTM D5800.

23. The saturated hydrocarbon base oil according to claim 1, wherein the saturated hydrocarbon base oil comprises a Noack Volatility which is less than 7% loss by ASTM D5800.

24. The saturated hydrocarbon base oil according to claim 1, wherein the saturated hydrocarbon base oil comprises a Noack Volatility by ASTM D5800 which is less than the value of the following equation:

Noack Volatility≤−1583.3(KV100)^2+13858 (KV100)−28500.

* * * * *